US010847075B1

(12) United States Patent
Buckley et al.

(10) Patent No.: US 10,847,075 B1
(45) Date of Patent: Nov. 24, 2020

(54) ERROR CORRECTION FOR DISPLAY DEVICE

(71) Applicant: Facebook Technologies, LLC, Menlo Park, CA (US)

(72) Inventors: Edward Buckley, Redmond, WA (US); Cameron Maehara Lee, Fall City, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/380,231

(22) Filed: Apr. 10, 2019

(51) Int. Cl.

| | |
|---|---|
| ***G09G 5/10*** | (2006.01) |
| ***G09G 3/20*** | (2006.01) |
| ***G09G 3/32*** | (2016.01) |
| ***G09G 5/06*** | (2006.01) |

(52) U.S. Cl.
CPC ..... *G09G 3/2003* (2013.01); *G09G 3/2044* (2013.01); *G09G 3/32* (2013.01); *G09G 5/06* (2013.01); *G09G 2320/0242* (2013.01); *G09G 2320/0666* (2013.01); *G09G 2320/0686* (2013.01)

(58) Field of Classification Search
USPC ..... 345/593, 589, 691, 690; 358/1.9
See application file for complete search history.

(56) References Cited

U.S. PATENT DOCUMENTS 5,353,127 A 10/1994 Shiau et al.
5,734,368 A * 3/1998 Meyers ..... H04N 1/644 345/593
6,556,214 B1 * 4/2003 Yamada ..... G09G 3/2022 345/589
6,633,407 B1 * 10/2003 Kim ..... G06F 16/5838 358/1.9
2003/0067616 A1 4/2003 Toyoda et al.
2007/0115228 A1 5/2007 Roberts et al.
2011/0128602 A1 6/2011 Hamano et al.
2012/0212515 A1 8/2012 Hamer et al.
2013/0321477 A1 * 12/2013 Gandhi ..... G09G 3/2022 345/690

(Continued)

OTHER PUBLICATIONS

PCT International Search Report and Written Opinion, PCT Application No. PCT/US2019/020068, dated Jun. 19, 2019,15 pages.

(Continued)

*Primary Examiner* — Thuy N Pardo
(74) *Attorney, Agent, or Firm* — Fenwick & West LLP

(57) ABSTRACT

A display device has an image processing unit that determines an error for a pixel location that is based on the difference between an input color dataset and an output color dataset. The error is fed back to the image processing unit to propagate and spread across other neighboring pixel locations. In generating the output color values, the most significant bits (MSBs) and the least significant bits (LSBs) may be treated separately. The display device may extract the MSBs from the input and generate a first output color sub-dataset that is related to the MSBs. The display device may determine the LSBs from a difference between the input color dataset and the output MSBs. The display device may process the LSBs to compensate, adjust, scale, and quantize the values. The MSBs and LSBs may be re-combined to determine an actual color value displayed at the pixel location to determine the error.

20 Claims, 18 Drawing Sheets

(56) References Cited

U.S. PATENT DOCUMENTS

| | | | | |
|---|---|---|---|---|
| 2014/0078197 | A1 | 3/2014 | Park et al. | |
| 2014/0118427 | A1* | 5/2014 | Buckley | G09G 3/3433 345/691 |
| 2015/0130827 | A1* | 5/2015 | Mizushiro | H04N 9/3182 345/589 |
| 2015/0154920 | A1* | 6/2015 | Buckley | G09G 3/2022 345/690 |
| 2015/0287354 | A1 | 10/2015 | Wang et al. | |
| 2015/0350492 | A1 | 12/2015 | Kurtz et al. | |
| 2016/0226585 | A1* | 8/2016 | Sibecas | H04B 10/116 345/691 |
| 2018/0068606 | A1* | 3/2018 | Dighde | G09G 3/3413 345/691 |
| 2019/0259235 | A1* | 8/2019 | Leiendecker | G06K 7/084 345/691 |

OTHER PUBLICATIONS

United States Office Action, U.S. Appl. No. 16/261,021, dated Mar. 20, 2020, 14 pages.
United States Office Action, U.S. Appl. No. 16/261,021, dated Jun. 26, 2020, 14 pages.

* cited by examiner

ERROR CORRECTION FOR DISPLAY DEVICE

BACKGROUND

This disclosure relates to structure and operation of a display device and more specifically to error propagation and correction in an image processing unit of a display device. A virtual reality (VR) or augmented-reality (AR) system often includes a head-mounted display or a near-eye display for users to immerse in the simulated environment. The image quality generated by the display device directly affects the users' perception of the simulated reality and the enjoyment of the VR or AR system. Since the display device is often head mounted or portable, the display device is subject to different types of limitations such as size, distance, and power. The limitations may affect the precisions of the display in rendering images, which may result in various visual artifacts, thus negatively impacting the user experience with the VR or AR system.

SUMMARY

Embodiments described herein generally relate to error correction processes for display devices by determining an error at a pixel location and use the determined error to dither color values of nearby pixel locations so that the nearby pixel locations may collaboratively compensate for the error. A display device may include a display panel with light emitters that may not be able to perfectly produce the precise color value that is specified by an image source. The color values intended to be displayed and the actual color value that is displayed may vary. Those variations, however small, may affect the overall image quality and the perceived color depth of the display device. An image processing unit of the display device determines the error at a pixel location resulted from those variations and performs dithering of color datasets of neighboring pixel locations to compensate for the error.

In accordance with an embodiment, a display device may separately process a first subset of bits and a second subset of bits of color values. In one case, the display device receives an input color dataset representing a color value intended to be displayed at a pixel location. The display device extracts the first subset of bits in the input color dataset. The first subset of bits may include the most significant bits of the input color dataset. The display device adjusts the first subset of bits to compensate for shifts of the color of a first set of light emitters to generate a first output color sub-dataset for driving the first set of light emitters. The first set of light emitters emits light onto the first pixel location. The display device also generates a second subset of bits. The second subset of bits may be derived from the difference between the first output color sub-dataset and the input color dataset. The display device adjusts the second subset of bits to compensate for shifts of the color of a second set of light emitters to generate a second output color sub-dataset for driving the second set of light emitters. The second set of light emitters light onto the first pixel location.

In one embodiment, the display device carries out dithering by feeding back some of the errors to pixel locations that are in proximity of the first pixel location. The display device combines the first and second color output sub-datasets to generate a combined output dataset. The combined output dataset may represent the actual color that is displayed at the pixel location. The display device determines an error dataset corresponding to the first pixel location from a difference between the input color dataset and the combined color dataset. The display device applies a dither algorithm to generate a plurality of error correction datasets from the error dataset. Each of the plurality of error correction datasets is fed back for adjusting values of a nearby pixel location that is in the proximity of the first pixel location. The display device receives a second input color dataset for a second pixel location that is one of the nearby pixel locations. The display devices add one of error correction datasets corresponding to the second pixel location to the second input color dataset.

The figures depict embodiments of the present disclosure for purposes of illustration only.

DETAILED DESCRIPTION

Embodiments relate to display devices that perform operations for compensating for the error at a pixel location through adjustment of color values at neighboring pixel locations. One or more dithering techniques are used across one or more nearby pixel locations to compensate for the error at a given pixel location. In one embodiment, a first subset of bits of a color value for the pixel location is processed and generated. A second subset of bits of the color value is derived from comparing the first subset of bits of the actual color generated by light emitters to the input color value specified in the input color dataset. The second subset of bits is corrected for color shifting. Any uncorrected errors are propagated to nearby pixel locations using one or more dithering techniques. In ths sway, the perceived accuracy of color reproduction at the display device can be improved.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Near-Eye Display

Figure 1:
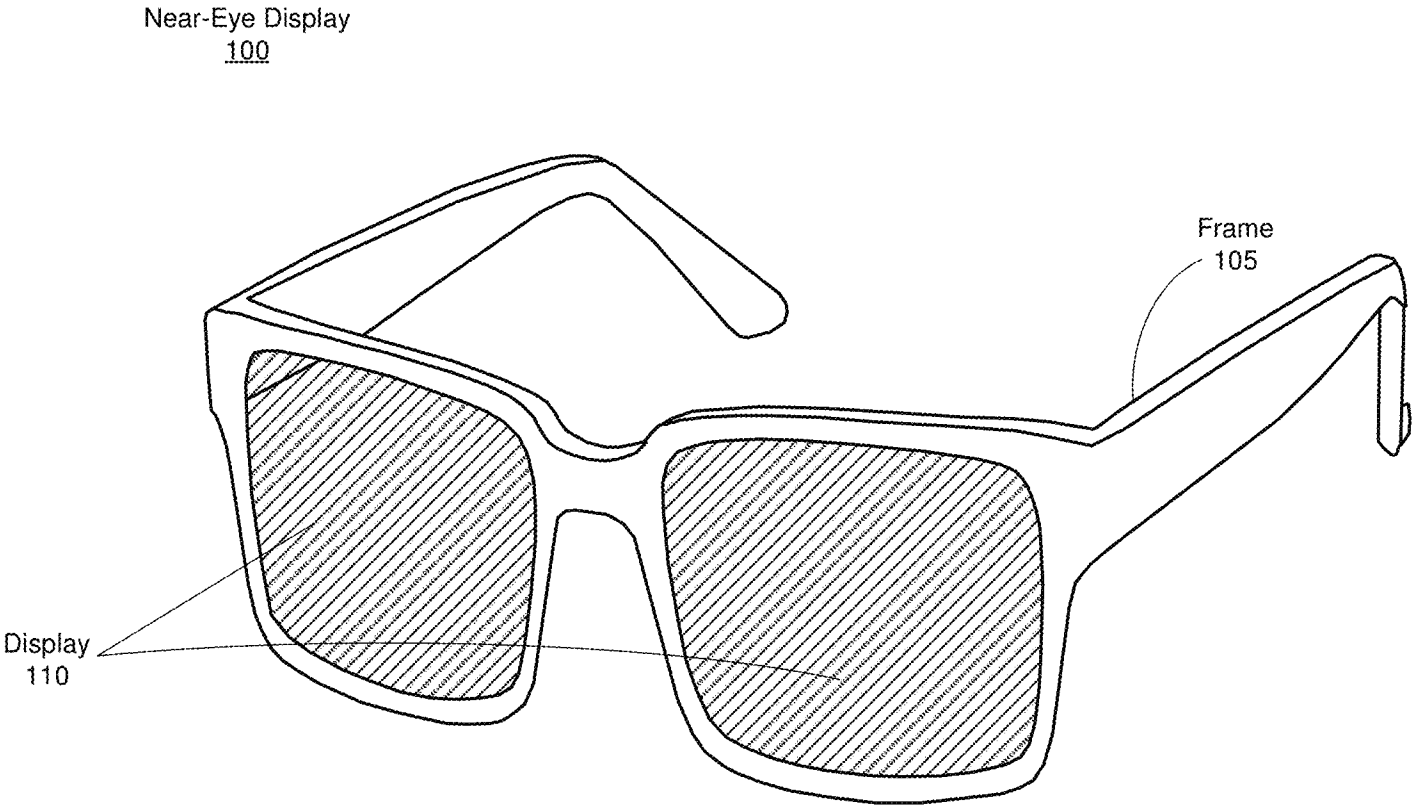
FIG. 1 is a perspective view of a near-eye-display (NED), in accordance with an embodiment.

FIG. 1 is a diagram of a near-eye display (NED) 100, in accordance with an embodiment. The NED 100 presents media to a user. Examples of media presented by the NED 100 include one or more images, video, audio, or some combination thereof. In some embodiments, audio is presented via an external device (e.g., speakers and/or headphones) that receives audio information from the NED 100, a console (not shown), or both, and presents audio data based on the audio information. The NED 100 may operate as a VR NED. However, in some embodiments, the NED 100 may be modified to also operate as an augmented reality (AR) NED, a mixed reality (MR) NED, or some combination thereof. For example, in some embodiments, the NED 100 may augment views of a physical, real-world environment with computer-generated elements (e.g., images, video, sound, etc.).

The NED 100 shown in FIG. 1 includes a frame 105 and a display 110. The frame 105 includes one or more optical elements which together display media to users. The display 110 is configured for users to see the content presented by the NED 100. As discussed below in conjunction with FIG. 2, the display 110 includes at least a source assembly to generate an image light to present media to an eye of the user. The source assembly includes, e.g., a light source, an optics system, or some combination thereof.

FIG. 1 is only an example of a VR system. However, in alternate embodiments, FIG. 1 may also be referred to as a Head-Mounted-Display (HMD).

Figure 2:
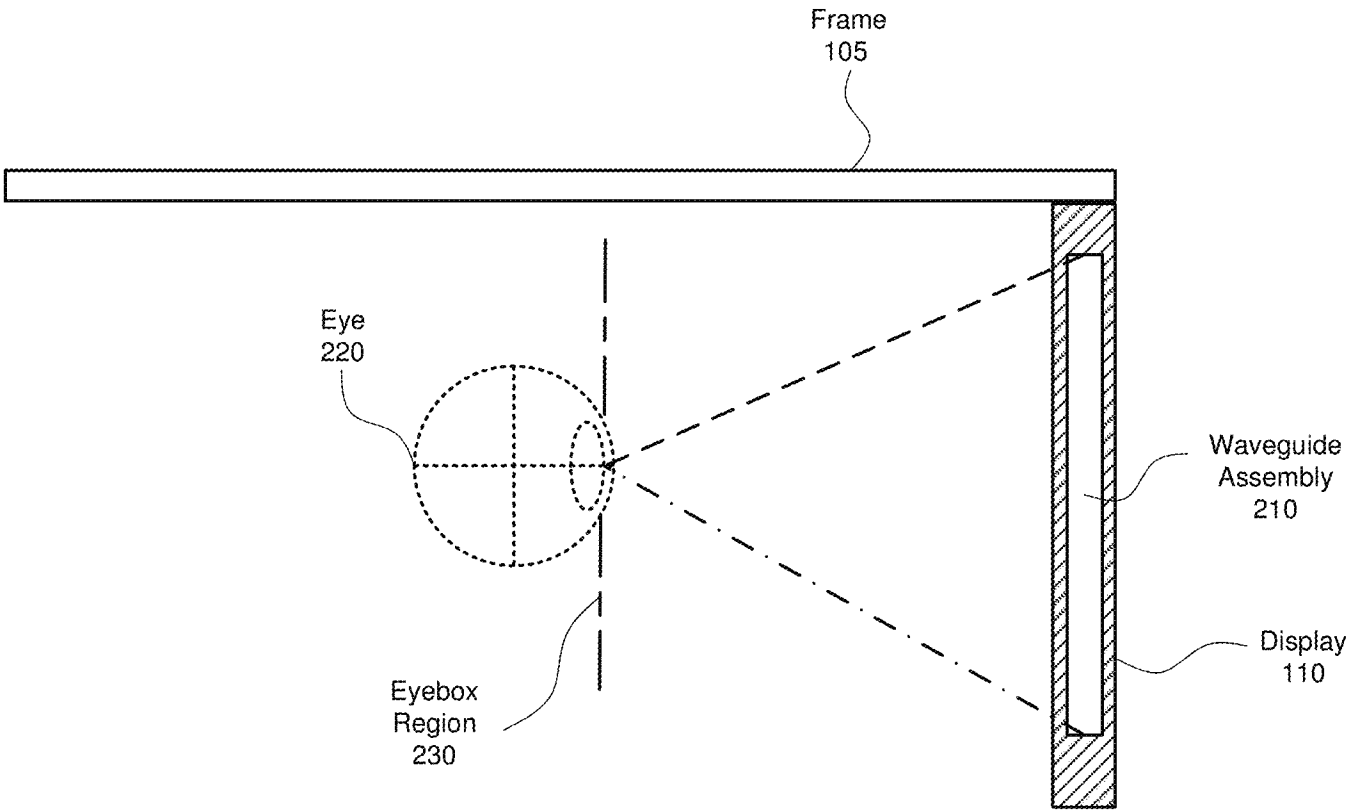
FIG. 2 is a cross-section of an eyewear of the NED illustrated in FIG. 1, in accordance with an embodiment.

FIG. 2 is a cross section of the NED 100 illustrated in FIG. 1, in accordance with an embodiment. The cross section illustrates at least one waveguide assembly 210. An exit pupil is a location where the eye 220 is positioned in an eyebox region 230 when the user wears the NED 100. In some embodiments, the frame 105 may represent a frame of eye-wear glasses. For purposes of illustration, FIG. 2 shows the cross section associated with a single eye 220 and a single waveguide assembly 210, but in alternative embodiments not shown, another waveguide assembly which is separate from the waveguide assembly 210 shown in FIG. 2, provides image light to another eye 220 of the user.

The waveguide assembly 210, as illustrated below in FIG. 2, directs the image light to the eye 220 through the exit pupil. The waveguide assembly 210 may be composed of one or more materials (e.g., plastic, glass, etc.) with one or more refractive indices that effectively minimize the weight and widen a field of view (hereinafter abbreviated as 'FOV') of the NED 100. The waveguide assembly 210 may include one or more waveguides. In alternate configurations, the NED 100 includes one or more optical elements between the waveguide assembly 210 and the eye 220. The optical elements may act (e.g., correct aberrations in image light emitted from the waveguide assembly 210) to magnify image light emitted from the waveguide assembly 210, some other optical adjustment of image light emitted from the waveguide assembly 210, or some combination thereof. The example for optical elements may include an aperture, a Fresnel lens, a convex lens, a concave lens, a filter, or any other suitable optical element that affects image light. In one embodiment, the waveguide assembly 210 may produce and direct many pupil replications to the eyebox region 230, in a manner that will be discussed in further detail below in association with FIG. 5B.

Figure 3A:
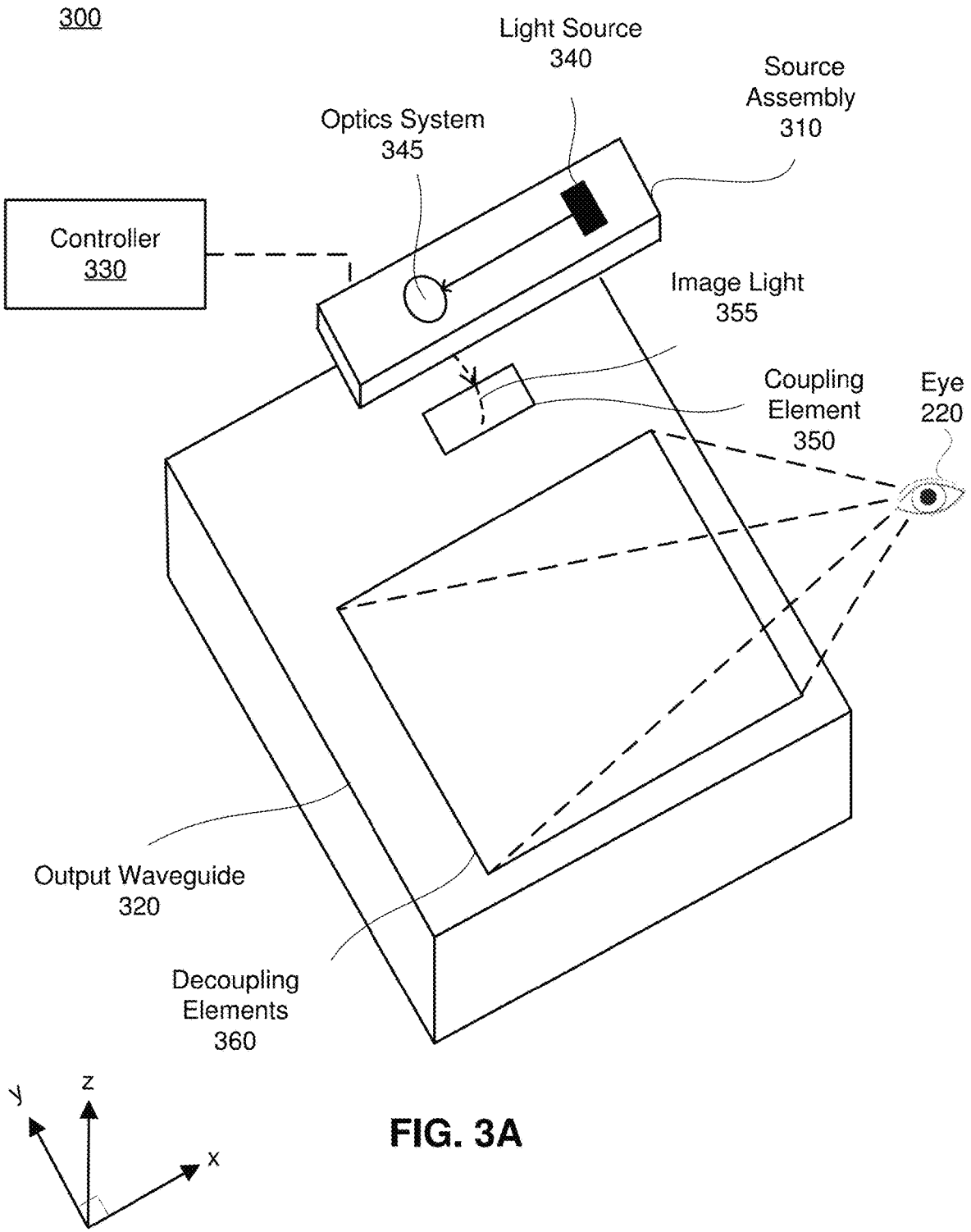
FIG. 3A is a perspective view of a display device, in accordance with an embodiment.

FIG. 3A illustrates a perspective view of a display device 300, in accordance with an embodiment. In some embodiments, the display device 300 is a component (e.g., the waveguide assembly 210 or part of the waveguide assembly 210) of the NED 100. In alternative embodiments, the display device 300 is part of some other NEDs, or another system that directs display image light to a particular location. Depending on embodiments and implementations, the display device 300 may also be referred to as a waveguide display and/or a scanning display. However, in other embodiment, the display device 300 does not include a scanning mirror. For example, the display device 300 can include matrices of light emitters that project light on an image field through a waveguide but without a scanning mirror. In another embodiment, the image emitted by the two-dimensional matrix of light emitters may be magnified by an optical assembly (e.g., lens) before the light arrives a waveguide or a screen.

For a particular embodiment that uses a waveguide and an optical system, the display device 300 may include a source assembly 310, an output waveguide 320, and a controller 330. The display device 300 may provide images for both eyes or for a single eye. For purposes of illustration, FIG. 3A shows the display device 300 associated with a single eye 220. Another display device (not shown), separated (or partially separated) from the display device 300, provides image light to another eye of the user. In a partially separated system, one or more components may be shared between display devices for each eye.

The source assembly 310 generates image light 355. The source assembly 310 includes a light source 340 and an optics system 345. The light source 340 is an optical component that generates image light using a plurality of light emitters arranged in a matrix. Each light emitter may emit monochromatic light. The light source 340 generates image light including, but not restricted to, Red image light, Blue image light, Green image light, infra-red image light, etc. While RGB is often discussed in this disclosure, embodiments described herein are not limited to using red, blue and green as primary colors. Other colors are also possible to be used as the primary colors of the display device. Also, a display device in accordance with an embodiment may use more than three primary colors.

The optics system 345 performs a set of optical processes, including, but not restricted to, focusing, combining, conditioning, and scanning processes on the image light generated by the light source 340. In some embodiments, the optics system 345 includes a combining assembly, a light conditioning assembly, and a scanning mirror assembly, as described below in detail in conjunction with FIG. 3B. The source assembly 310 generates and outputs an image light 355 to a coupling element 350 of the output waveguide 320.

The output waveguide 320 is an optical waveguide that outputs image light to an eye 220 of a user. The output waveguide 320 receives the image light 355 at one or more coupling elements 350, and guides the received input image light to one or more decoupling elements 360. The coupling element 350 may be, e.g., a diffraction grating, a holographic grating, some other element that couples the image light 355 into the output waveguide 320, or some combination thereof. For example, in embodiments where the coupling element 350 is diffraction grating, the pitch of the diffraction grating is chosen such that total internal reflection occurs, and the image light 355 propagates internally toward the decoupling element 360. The pitch of the diffraction grating may be in the range of 300 nm to 600 nm.

The decoupling element 360 decouples the total internally reflected image light from the output waveguide 320. The decoupling element 360 may be, e.g., a diffraction grating, a holographic grating, some other element that decouples image light out of the output waveguide 320, or some combination thereof. For example, in embodiments where the decoupling element 360 is a diffraction grating, the pitch of the diffraction grating is chosen to cause incident image light to exit the output waveguide 320. An orientation and position of the image light exiting from the output waveguide 320 are controlled by changing an orientation and position of the image light 355 entering the coupling element 350. The pitch of the diffraction grating may be in the range of 300 nm to 600 nm.

The output waveguide 320 may be composed of one or more materials that facilitate total internal reflection of the image light 355. The output waveguide 320 may be composed of e.g., silicon, plastic, glass, or polymers, or some combination thereof. The output waveguide 320 has a relatively small form factor. For example, the output waveguide 320 may be approximately 50 mm wide along X-dimension, 30 mm long along Y-dimension and 0.5-1 mm thick along Z-dimension.

The controller 330 controls the image rendering operations of the source assembly 310. The controller 330 determines instructions for the source assembly 310 based at least on the one or more display instructions. Display instructions are instructions to render one or more images. In some embodiments, display instructions may simply be an image file (e.g., bitmap). The display instructions may be received from, e.g., a console of a VR system (not shown here). Scanning instructions are instructions used by the source assembly 310 to generate image light 355. The scanning instructions may include, e.g., a type of a source of image light (e.g., monochromatic, polychromatic), a scanning rate, an orientation of a scanning apparatus, one or more illumination parameters, or some combination thereof. The controller 330 includes a combination of hardware, software, and/or firmware not shown here so as not to obscure other aspects of the disclosure.

Figure 3B:
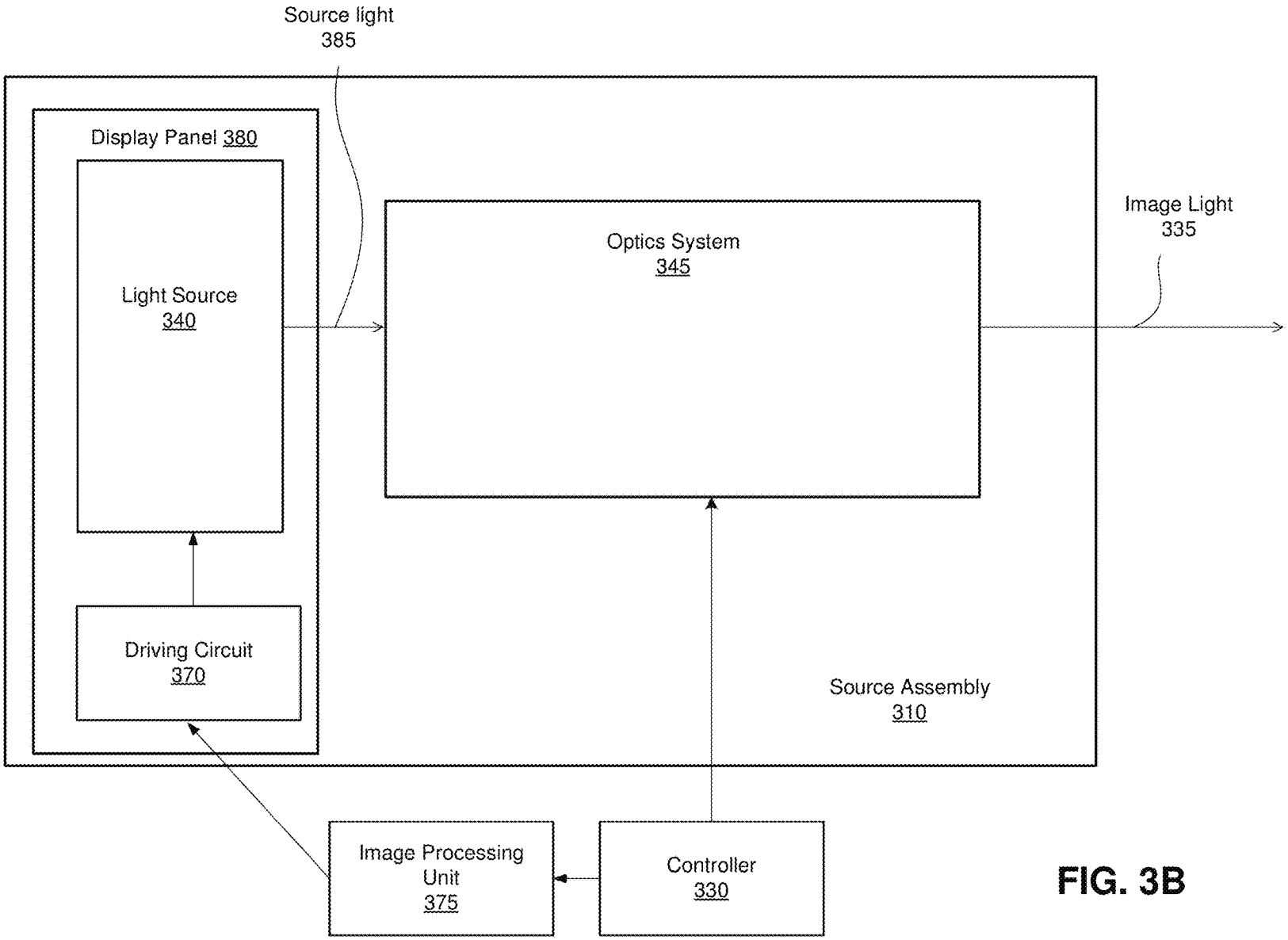
FIG. 3B is a block diagram of a display device, in accordance with an embodiment.

FIG. 3B is a block diagram illustrating an example source assembly 310, in accordance with an embodiment. The source assembly 310 includes the light source 340 that emits light that is processed optically by the optics system 345 to generate image light 335 that will be projected on an image field (not shown). The light source 340 is driven by the driving circuit 370 based on the data sent from a controller 330 or an image processing unit 375. In one embodiment, the driving circuit 370 is the circuit panel that connects to and mechanically holds various light emitters of the light source 340. The driving circuit 370 and the light source 340 combined may sometimes be referred to as a display panel 380 or an LED panel (if some forms of LEDs are used as the light emitters).

The light source 340 may generate a spatially coherent or a partially spatially coherent image light. The light source 340 may include multiple light emitters. The light emitters can be vertical cavity surface emitting laser (VCSEL) devices, light emitting diodes (LEDs), microLEDs, tunable lasers, and/or some other light-emitting devices. In one embodiment, the light source 340 includes a matrix of light emitters. In another embodiment, the light source 340 includes multiple sets of light emitters with each set grouped by color and arranged in a matrix form. The light source 340 emits light in a visible band (e.g., from about 390 nm to 700 nm). The light source 340 emits light in accordance with one or more illumination parameters that are set by the controller 330 and potentially adjusted by image processing unit 375 and driving circuit 370. An illumination parameter is an instruction used by the light source 340 to generate light. An illumination parameter may include, e.g., source wavelength, pulse rate, pulse amplitude, beam type (continuous or pulsed), other parameter(s) that affect the emitted light, or some combination thereof. The light source 340 emits source light 385. In some embodiments, the source light 385 includes multiple beams of Red light, Green light, and Blue light, or some combination thereof.

The optics system 345 may include one or more optical components that optically adjust and potentially re-direct the light from the light source 340. One form of example adjustment of light may include conditioning the light. Conditioning the light from the light source 340 may include, e.g., expanding, collimating, correcting for one or more optical errors (e.g., field curvature, chromatic aberration, etc.), some other adjustment of the light, or some combination thereof. The optical components of the optics system 345 may include, e.g., lenses, mirrors, apertures, gratings, or some combination thereof. Light emitted from the optics system 345 is referred to as an image light 355.

The optics system 345 may redirect image light via its one or more reflective and/or refractive portions so that the image light 355 is projected at a particular orientation toward the output waveguide 320 (shown in FIG. 3A). Where the image light is redirected toward is based on specific orientations of the one or more reflective and/or refractive portions. In some embodiments, the optics system 345 includes a single scanning mirror that scans in at least two dimensions. In other embodiments, the optics system 345 may include a plurality of scanning mirrors that each scan in orthogonal directions to each other. The optics system 345 may perform a raster scan (horizontally, or vertically), a biresonant scan, or some combination thereof. In some embodiments, the optics system 345 may perform a controlled vibration along the horizontal and/or vertical directions with a specific frequency of oscillation to scan along two dimensions and generate a two-dimensional projected line image of the media presented to user's eyes. In other embodiments, the optics system 345 may also include a lens that serves similar or same function as one or more scanning mirror.

In some embodiments, the optics system 345 includes a galvanometer mirror. For example, the galvanometer mirror may represent any electromechanical instrument that indicates that it has sensed an electric current by deflecting a beam of image light with one or more mirrors. The galvanometer mirror may scan in at least one orthogonal dimension to generate the image light 355. The image light 355 from the galvanometer mirror represents a two-dimensional line image of the media presented to the user's eyes.

In some embodiments, the source assembly 310 does not include an optics system. The light emitted by the light source 340 is projected directly to the waveguide 320 (shown in FIG. 3A).

The controller 330 controls the operations of light source 340 and, in some cases, the optics system 345. In some embodiments, the controller 330 may be the graphics processing unit (GPU) of a display device. In other embodiments, the controller 330 may be other kinds of processors. The operations performed by the controller 330 includes taking content for display, and dividing the content into discrete sections. The controller 330 instructs the light source 340 to sequentially present the discrete sections using light emitters corresponding to a respective row in an image ultimately displayed to the user. The controller 330 instructs the optics system 345 to perform different adjustment of the light. For example, the controller 330 controls the optics system 345 to scan the presented discrete sections to different areas of a coupling element of the output waveguide 320 (shown in FIG. 3A). Accordingly, at the exit pupil of the output waveguide 320, each discrete portion is presented in a different location. While each discrete section is presented at different times, the presentation and scanning of the discrete sections occur fast enough such that a user's eye integrates the different sections into a single image or series of images. The controller 330 may also provide scanning instructions to the light source 340 that include an address corresponding to an individual source element of the light source 340 and/or an electrical bias applied to the individual source element.

The image processing unit 375 may be a general-purpose processor and/or one or more application-specific circuits that are dedicated to performing the features described herein. In one embodiment, a general-purpose processor may be coupled to a memory to execute software instructions that cause the processor to perform certain processes described herein. In another embodiment, the image processing unit 375 may be one or more circuits that are dedicated to performing certain features. While in FIG. 3B the image processing unit 375 is shown as a stand-alone unit that is separate from the controller 330 and the driving circuit 370, in other embodiments the image processing unit 375 may be a sub-unit of the controller 330 or the driving circuit 370. In other words, in those embodiments, the controller 330 or the driving circuit 370 performs various image processing procedures of the image processing unit 375. The image processing unit 375 may also be referred to as an image processing circuit.

Light Emitters

FIGS. 4A through 4E are conceptual diagrams that illustrate different light emitters' structure and arrangement, in accordance with various embodiments.

Figure 4A:
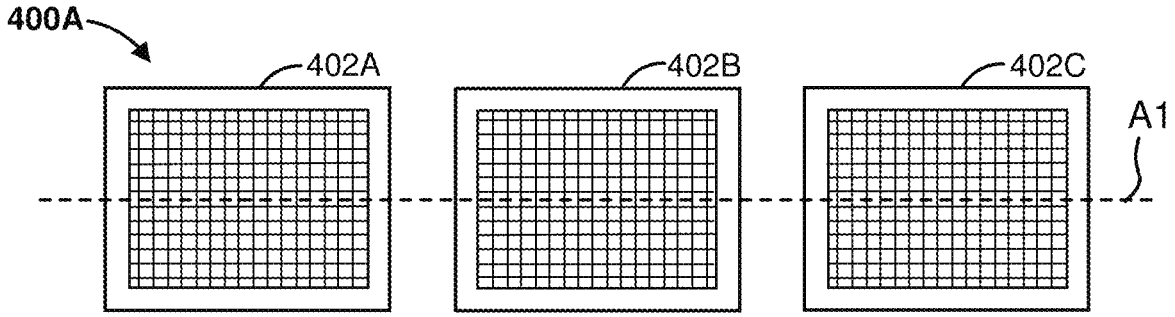
FIGS. 4A, 4B, and 4C are conceptual diagrams illustrating different arrangements of light emitters, in accordance with some embodiments.
Figure 4B:
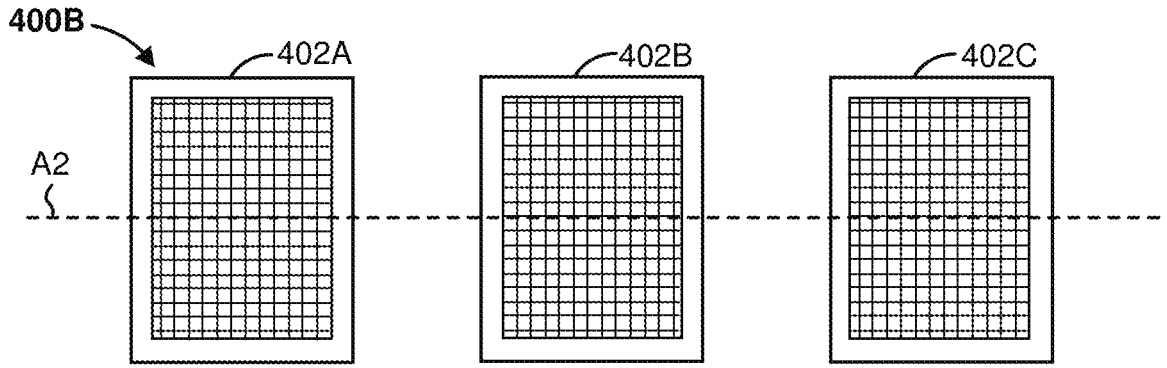
Figure 4C:
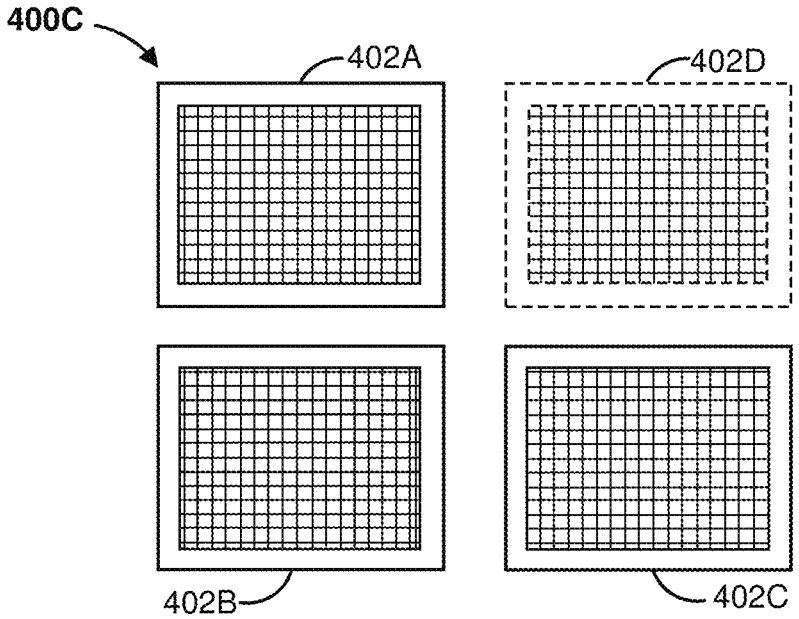

FIGS. 4A, 4B, and 4C are top views of matrix arrangement of light emitters' that may be included in the light source 340 of FIGS. 3A and 3B, in accordance to some embodiments. The configuration 400A shown in FIG. 4A is a linear configuration of the light emitter arrays 402A-C of FIG. 4A along the axis A1. This particular linear configuration may be arranged according to a longer side of the rectangular light emitter arrays 402. While the light emitter arrays 402 may have a square configuration of light emitters in some embodiments, other embodiments may include a rectangular configuration of light emitters. The light emitter arrays 402A-C each include multiple rows and columns of light emitters. Each light emitter array 402A-C may include light emitters of a single color. For example, light emitter array 402A may include red light emitters, light emitter array 402B may include green light emitters, and light emitter array 402C may include blue light emitters. In other embodiments, the light emitter arrays 402A-C may have other configurations (e.g., oval, circular, or otherwise rounded in some fashion) while defining a first dimension (e.g., a width) and a second dimension (e.g., length) orthogonal to the first direction, with one dimension being either equal or unequal to each other. In FIG. 4B, the light emitter arrays 402A-C may be disposed in a linear configuration 400B according to a shorter side of the rectangular light emitter arrays 402, along an axis A2. FIG. 4C shows a triangular configuration of the light emitter arrays 402A-C in which the centers of the light emitter arrays 402 form a non-linear (e.g., triangular) shape or configuration. Some embodiments of the configuration 400C of FIG. 4C may further include a white-light emitter array 402D, such that the light emitter arrays 402 are in a rectangular or square configuration. The light emitter arrays 402 may have a two-dimensional light emitter configuration with more than 1000 by 1000 light emitters, in some embodiments. Various other configurations are also within the scope of the present disclosure.

While the matrix arrangements of light emitters shown in FIGS. 4A-4C are arranged in perpendicular rows and columns, in other embodiments the matrix arrangements may be arranged other forms. For example, some of the light emitters may be aligned diagonally or in other arrangements, regular or irregular, symmetrical or asymmetrical. Also, the terms rows and columns may describe two relative spatial relationships of elements. While, for the purpose of simplicity, a column described herein is normally associated with a vertical line of elements, it should be understood that a column does not have to be arranged vertically (or longitudinally). Likewise, a row does not have to be arranged horizontally (or laterally). A row and a column may also sometimes describe an arrangement that is non-linear. Rows and columns also do not necessarily imply any parallel or perpendicular arrangement. Sometimes a row or a column may be referred to as a line. Also, in some embodiments, the light emitters may not be arranged in a matrix configuration. For example, in some display devices that include a rotating mirror that will be discussed in further details in FIG. 5A, there may be a single line of light emitters for each color. In other embodiments, there may be two or three lines of light emitters for each color.

Figure 4D:
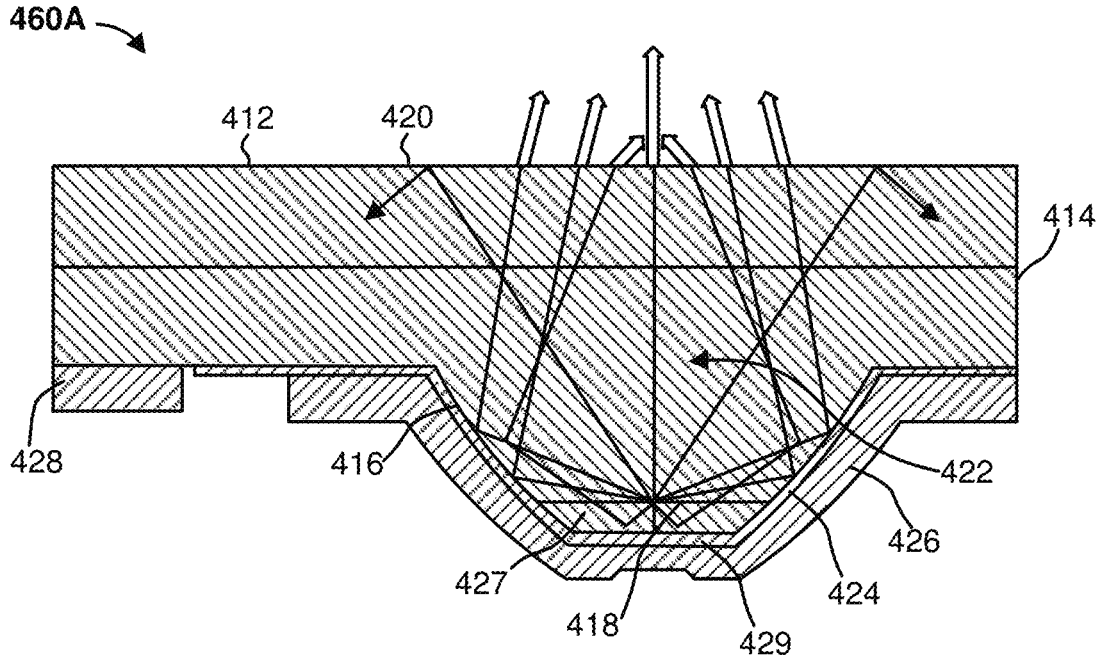
FIGS. 4D and 4E are schematic cross-sectional diagrams of light emitters, in accordance with some embodiments.
Figure 4E:
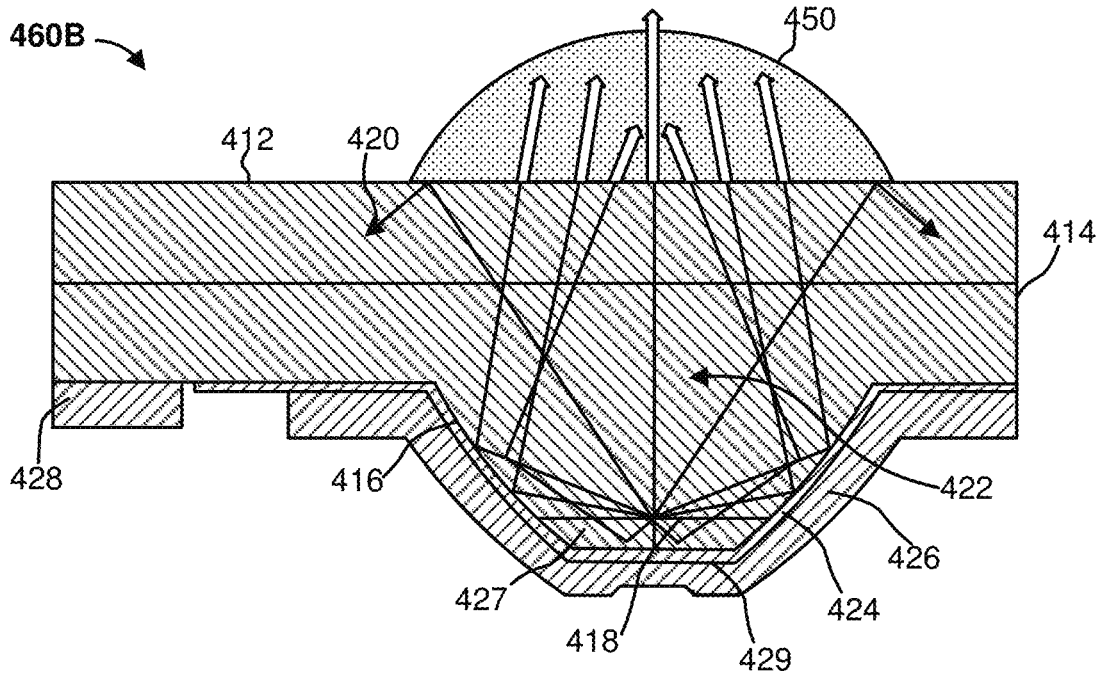

FIGS. 4D and 4E are schematic cross-sectional diagrams of an example of light emitters 410 that may be used as an individual light emitter in the light emitter arrays 402 of FIGS. 4A-C, in accordance with some embodiments. In one embodiment, the light emitter 410 may be microLED 460A. In other embodiments, other types of light emitters may be used and do not need to be microLED. FIG. 4D shows a schematic cross-section of a microLED 460A. A "microLED" may be a particular type of LED having a small active light emitting area (e.g., less than 2,000 $\mu m^2$ in some embodiments, less than 20 $\mu m^2$ or less than 10 $\mu m^2$ in other embodiments). In some embodiments, the emissive surface of the microLED 460A may have a diameter of less than approximately 5 μm, although smaller (e.g., 2 μm) or larger diameters for the emissive surface may be utilized in other embodiments. The microLED 460A may also have collimated or non-Lambertian light output, in some examples, which may increase the brightness level of light emitted from a small active light-emitting area.

The microLED 460A may include, among other components, an LED substrate 412 with a semiconductor epitaxial layer 414 disposed on the substrate 412, a dielectric layer 424 and a p-contact 429 disposed on the epitaxial layer 414, a metal reflector layer 426 disposed on the dielectric layer 424 and p-contact 429, and an n-contact 428 disposed on the epitaxial layer 414. The epitaxial layer 414 may be shaped into a mesa 416. An active light-emitting area 418 may be formed in the structure of the mesa 416 by way of a p-doped region 427 of the epitaxial layer 414.

The substrate 412 may include transparent materials such as sapphire or glass. In one embodiment, the substrate 412 may include silicon, silicon oxide, silicon dioxide, aluminum oxide, sapphire, an alloy of silicon and germanium, indium phosphide (InP), and the like. In some embodiments, the substrate 412 may include a semiconductor material (e.g., monocrystalline silicon, germanium, silicon germanium (SiGe), and/or a III-V based material (e.g., gallium arsenide), or any combination thereof. In various embodiments, the substrate 412 can include a polymer-based substrate, glass, or any other bendable substrate including two-dimensional materials (e.g., graphene and molybdenum disulfide), organic materials (e.g., pentacene), transparent oxides (e.g., indium gallium zinc oxide (IGZO)), polycrystalline III-V materials, polycrystalline germanium, polycrystalline silicon, amorphous III-V materials, amorphous germanium, amorphous silicon, or any combination thereof. In some embodiments, the substrate 412 may include a III-V compound semiconductor of the same type as the active LED (e.g., gallium nitride). In other examples, the substrate 412 may include a material having a lattice constant close to that of the epitaxial layer 414.

The epitaxial layer 414 may include gallium nitride (GaN) or gallium arsenide (GaAs). The active layer 418 may include indium gallium nitride (InGaN). The type and structure of semiconductor material used may vary to produce microLEDs that emit specific colors. In one embodiment, the semiconductor materials used can include a III-V semiconductor material. III-V semiconductor material layers can include those materials that are formed by combining group III elements (Al, Ga, In, etc.) with group V elements (N, P, As, Sb, etc.). The p-contact 429 and n-contact 428 may be contact layers formed from indium tin oxide (ITO) or another conductive material that can be transparent at the desired thickness or arrayed in a grid-like pattern to provide for both good optical transmission/transparency and electrical contact, which may result in the microLED 460A also being transparent or substantially transparent. In such examples, the metal reflector layer 426 may be omitted. In other embodiments, the p-contact 429 and the n-contact 428 may include contact layers formed from conductive material (e.g., metals) that may not be optically transmissive or transparent, depending on pixel design.

In some implementations, alternatives to ITO can be used, including wider-spectrum transparent conductive oxides (TCOs), conductive polymers, metal grids, carbon nanotubes (CNT), graphene, nanowire meshes, and thin-metal films. Additional TCOs can include doped binary compounds, such as aluminum-doped zinc-oxide (AZO) and indium-doped cadmium-oxide. Additional TCOs may include barium stannate and metal oxides, such as strontium vanadate and calcium vanadate. In some implementations, conductive polymers can be used. For example, a poly(3,4-ethylenedioxythiophene) PEDOT: poly(styrene sulfonate) PSS layer can be used. In another example, a poly(4,4-dioctyl cyclopentadithiophene) material doped with iodine or 2,3-dichloro-5,6-dicyano-1,4-benzoquinone (DDQ) can be used. The example polymers and similar materials can be spin-coated in some example embodiments.

In some embodiments, the p-contact 429 may be of a material that forms an ohmic contact with the p-doped region 427 of the mesa 416. Examiner of such materials may include, but are not limited to, palladium, nickel oxide deposited as a NiAu multilayer coating with subsequent oxidation and annealing, silver, nickel oxide/silver, gold/zinc, platinum gold, or other combinations that form ohmic contacts with p-doped III-V semiconductor material.

The mesa 416 of the epitaxial layer 414 may have a truncated top on a side opposed to a substrate light emissive surface 420 of the substrate 412. The mesa 416 may also have a parabolic or near-parabolic shape to form a reflective enclosure or parabolic reflector for light generated within the microLED 460A. However, while FIG. 4D depicts a parabolic or near-parabolic shape for the mesa 416, other shapes for the mesa 416 are possible in other embodiments. The arrows indicate how light 422 emitted from the active layer 418 may be reflected off the internal walls of the mesa 416 toward the light emissive surface 420 at an angle sufficient for the light to escape the microLED 460A (i.e., outside an angle of total internal reflection). The p-contact 429 and the n-contact 428 may electrically connect the microLED 460A to a substrate.

The parabolic-shaped structure of the microLED 460A may result in an increase in the extraction efficiency of the microLED 460A into low illumination angles when compared to unshaped or standard LEDs. Standard LED dies may generally provide an emission full width at half maximum (FWHM) angle of 120°. In comparison, the microLED 460A can be designed to provide controlled emission angle FWHM of less than standard LED dies, such as around 41°. This increased efficiency and collimated output of the microLED 460A can enable improvement in overall power efficiency of the NED, which can be important for thermal management and/or battery life.

The microLED 460A may include a circular cross-section when cut along a horizontal plane, as shown in FIG. 4D. However, the microLED 460A cross-section may be non-circular in other examples. The microLED 460A may have a parabolic structure etched directly onto the LED die during the wafer processing steps. The parabolic structure may include the active light-emitting area 418 of the microLED 460A to generate light, and the parabolic structure may reflect a portion of the generated light to form the quasi-collimated light 422 emitted from the substrate light emissive surface 420. In some examples, the optical size of the microLED 460A may be smaller than or equal to the active light-emitting area 418. In other embodiments, the optical size of the microLED 460A may be larger than the active light-emitting area 418, such as through a refractive or reflective approach, to improve usable brightness of the microLED 460A, including any chief ray angle (CRA) offsets to be produced by the light emitter array 402.

FIG. 4E depicts a microLED 460B that is similar in many respects to the microLED 460A of FIG. 4D. The microLED 460B may further include a microlens 450, which may be formed over the parabolic structure. In some embodiments, the microlens 450 may be formed by applying a polymer coating over the microLED 460A, patterning the coating, and reflowing the coating to achieve the desired lens curvature. The microlens 450 may be disposed over an emissive surface to alter a chief ray angle of the microLED 460B. In another embodiment, the microlens 450 may be formed by depositing a microlens material above the microLED 460A (for example, by a spin-on method or a deposition process). For example, a microlens template (not shown) having a curved upper surface can be patterned above the microlens material. In some embodiments, the microlens template may include a photoresist material exposed using a distributing exposing light dose (e.g., for a negative photoresist, more light is exposed at a bottom of the curvature and less light is exposed at a top of the curvature), developed, and baked to form a rounding shape. The microlens 450 can then be formed by selectively etching the microlens material according to the microlens template. In some embodiments, the shape of the microlens 450 may be formed by etching into the substrate 412. In other embodiments, other types of light-shaping or light-distributing elements, such as an annular lens, Fresnel lens, or photonic crystal structures, may be used instead of microlenses.

In some embodiments, microLED arrangements other than those specifically discussed above in conjunction with FIGS. 4D and 4E may be employed as a microLED in light emitter array 402. For example, the microLED may include isolated pillars of epitaxially grown light-emitting material surrounded by a metal reflector. The pixels of the light emitter array 402 may also include clusters of small pillars (e.g., nanowires) of epitaxially grown material that may or may not be surrounded by reflecting material or absorbing material to prevent optical crosstalk. In some examples, the microLED pixels may be individual metal p-contacts on a planar, epitaxially grown LED device, in which the individual pixels may be electrically isolated using passivation means, such as plasma treatment, ion-implantation, or the like. Such devices may be fabricated with light extraction enhancement methods, such as microlenses, diffractive structures, or photonic crystals. Other processes for fabricating the microLEDs of the dimensions noted above other than those specifically disclosed herein may be employed in other embodiments.

Formation of an Image

Figure 5A:
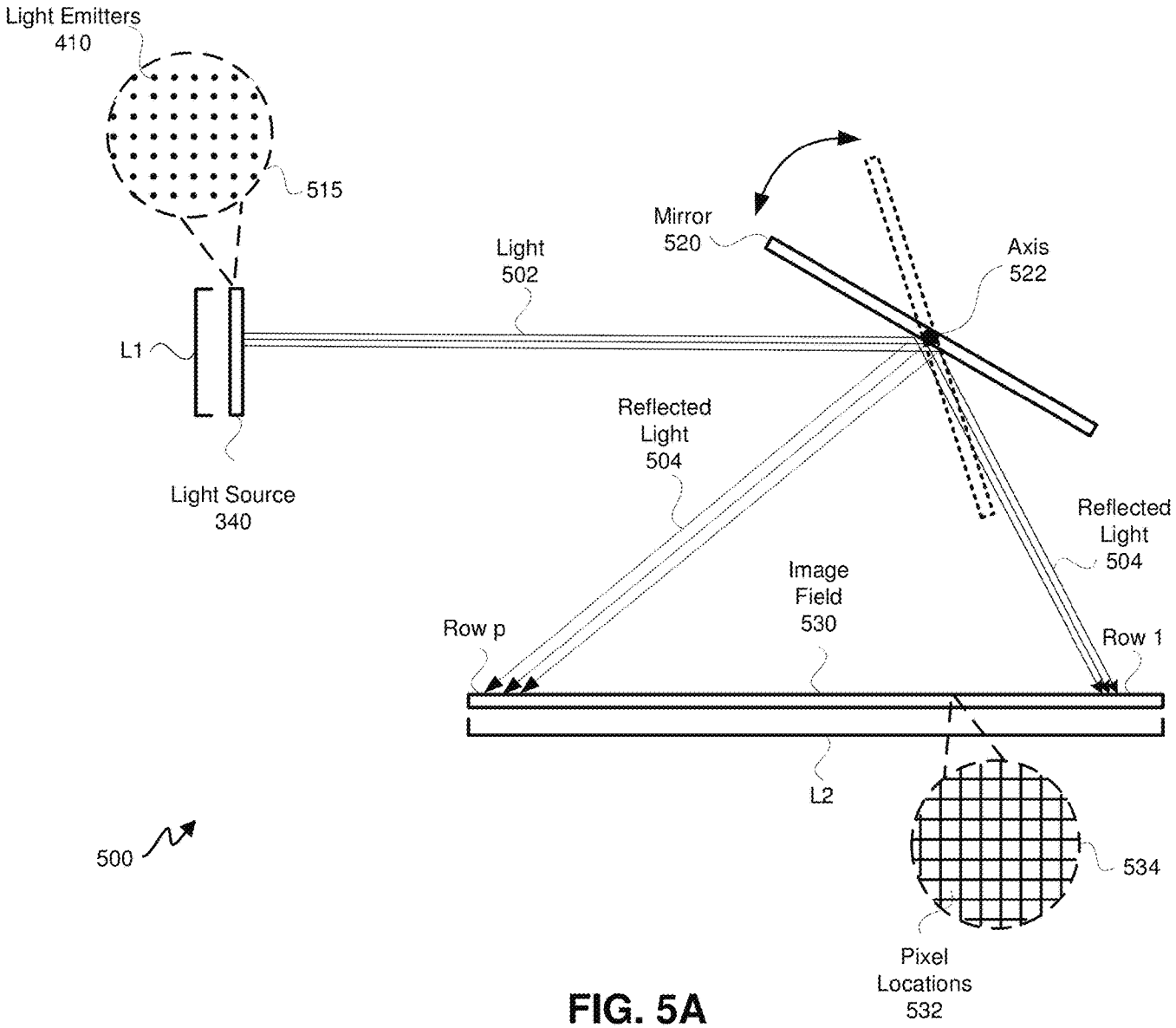
FIG. 5A is a diagram illustrating a scanning operation of a display device using a mirror to project light from a light source to an image field, in accordance with an embodiment.
Figure 5B:
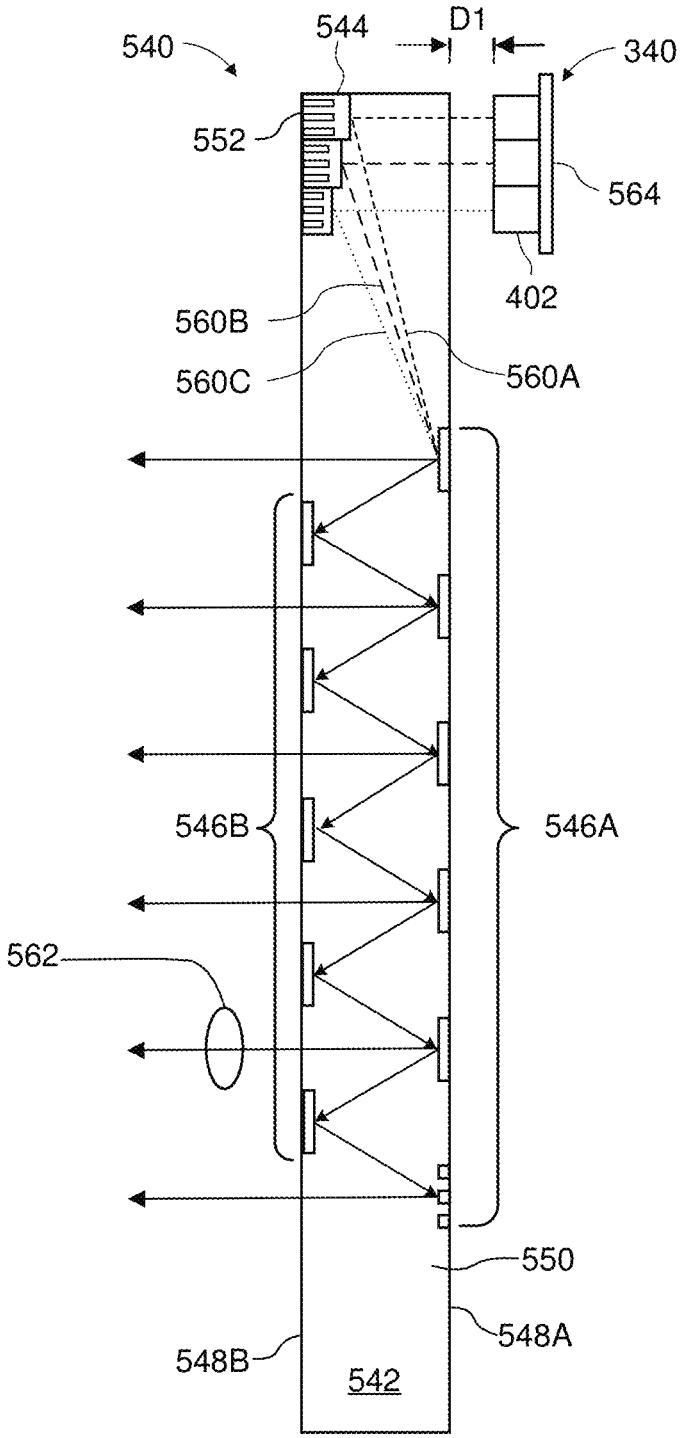
FIG. 5B is a diagram illustrating a waveguide configuration, in accordance with an embodiment.

FIGS. 5A and 5B illustrate how images and pupil replications are formed in a display device based on different structural arrangement of light emitters, in accordance with different embodiments. An image field is an area that receives the light emitted by the light source and forms an image. For example, an image field may correspond to a portion of the coupling element 350 or a portion of the decoupling element 360 in FIG. 3A. In some cases, an image field is not an actual physical structure but is an area to which the image light is projected and which the image is formed. In one embodiment, the image field is a surface of the coupling element 350 and the image formed on the image field is magnified as light travels through the output waveguide 320. In another embodiment, an image field is formed after light passing through the waveguide which combines the light of different colors to form the image field. In some embodiments, the image field may be projected directly into the user's eyes.

FIG. 5A is a diagram illustrating a scanning operation of a display device 500 using a scanning mirror 520 to project light from a light source 340 to an image field 530, in accordance with an embodiment. The display device 500 may correspond to the near-eye display 100 or another scan-type display device. The light source 340 may correspond to the light source 340 shown in FIG. 3B, or may be used in other display devices. The light source 340 includes multiple rows and columns of light emitters 410, as represented by the dots in inset 515. In one embodiment, the light source 340 may include a single line of light emitters 410 for each color. In other embodiments, the light source 340 may include more than one lines of light emitters 410 for each color. The light 502 emitted by the light source 340 may be a set of collimated beams of light. For example, the light 502 in FIG. 5 shows multiple beams that are emitted by a column of light emitters 410. Before reaching the mirror 520, the light 502 may be conditioned by different optical devices such as the conditioning assembly 430 (shown in FIG. 3B but not shown in FIG. 5). The mirror 520 reflects and projects the light 502 from the light source 340 to the image field 530. The mirror 520 rotates about an axis 522. The mirror 520 may be a microelectromechanical system (MEMS) mirror or any other suitable mirror. The mirror 520 may be an embodiment of the optics system 345 in FIG. 3B or a part of the optics system 345. As the mirror 520 rotates, the light 502 is directed to a different part of the image field 530, as illustrated by the reflected part of the light 504 in solid lines and the reflected part of the light 504 in dash lines.

At a particular orientation of the mirror 520 (i.e., a particular rotational angle), the light emitters 410 illuminate a portion of the image field 530 (e.g., a particular subset of multiple pixel locations 532 on the image field 530). In one embodiment, the light emitters 410 are arranged and spaced such that a light beam from each light emitter 410 is projected on a corresponding pixel location 532. In another embodiment, small light emitters such as microLEDs are used for light emitters 410 so that light beams from a subset of multiple light emitters are together projected at the same pixel location 532. In other words, a subset of multiple light emitters 410 collectively illuminates a single pixel location 532 at a time.

The image field 530 may also be referred to as a scan field because, when the light 502 is projected to an area of the image field 530, the area of the image field 530 is being illuminated by the light 502. The image field 530 may be spatially defined by a matrix of pixel locations 532 (represented by the blocks in inset 534) in rows and columns. A pixel location here refers to a single pixel. The pixel locations 532 (or simply the pixels) in the image field 530 sometimes may not actually be additional physical structure. Instead, the pixel locations 532 may be spatial regions that divide the image field 530. Also, the sizes and locations of the pixel locations 532 may depend on the projection of the light 502 from the light source 340. For example, at a given angle of rotation of the mirror 520, light beams emitted from the light source 340 may fall on an area of the image field 530. As such, the sizes and locations of pixel locations 532 of the image field 530 may be defined based on the location of each light beam. In some cases, a pixel location 532 may be subdivided spatially into subpixels (not shown). For example, a pixel location 532 may include a Red subpixel, a Green subpixel, and a Blue subpixel. The Red subpixel corresponds to a location at which one or more Red light beams are projected, etc. When subpixels are present, the color of a pixel 532 is based on the temporal and/or spatial average of the subpixels.

The number of rows and columns of light emitters 410 of the light source 340 may or may not be the same as the number of rows and columns of the pixel locations 532 in the image field 530. In one embodiment, the number of light emitters 410 in a row is equal to the number of pixel locations 532 in a row of the image field 530 while the number of light emitters 410 in a column is two or more but fewer than the number of pixel locations 532 in a column of the image field 530. Put differently, in such embodiment, the light source 340 has the same number of columns of light emitters 410 as the number of columns of pixel locations 532 in the image field 530 but has fewer rows than the image field 530. For example, in one specific embodiment, the light source 340 has about 1280 columns of light emitters 410, which is the same as the number of columns of pixel locations 532 of the image field 530, but only a handful of light emitters 410. The light source 340 may have a first length L1, which is measured from the first row to the last row of light emitters 410. The image field 530 has a second length L2, which is measured from row 1 to row p of the scan field 530. In one embodiment, L2 is greater than L1 (e.g., L2 is 50 to 10,000 times greater than L1).

Since the number of rows of pixel locations 532 is larger than the number of rows of light emitters 410 in some embodiments, the display device 500 uses the mirror 520 to project the light 502 to different rows of pixels at different times. As the mirror 520 rotates and the light 502 scans through the image field 530 quickly, an image is formed on the image field 530. In some embodiments, the light source 340 also has a smaller number of columns than the image field 530. The mirror 520 can rotate in two dimensions to fill the image field 530 with light (e.g., a raster-type scanning down rows then moving to new columns in the image field 530).

The display device may operate in predefined display periods. A display period may correspond to a duration of time in which an image is formed. For example, a display period may be associated with the frame rate (e.g., a reciprocal of the frame rate). In the particular embodiment of display device 500 that includes a rotating mirror, the display period may also be referred to as a scanning period. A complete cycle of rotation of the mirror 520 may be referred to as a scanning period. A scanning period herein refers to a predetermined cycle time during which the entire image field 530 is completely scanned. The scanning of the image field 530 is controlled by the mirror 520. The light generation of the display device 500 may be synchronized with the rotation of the mirror 520. For example, in one embodiment, the movement of the mirror 520 from an initial position that projects light to row 1 of the image field 530, to the last position that projects light to row p of the image field 530, and then back to the initial position is equal to a scanning period. The scanning period may also be related to the frame rate of the display device 500. By completing a scanning period, an image (e.g., a frame) is formed on the image field 530 per scanning period. Hence, the frame rate may correspond to the number of scanning periods in a second.

As the mirror 520 rotates, light scans through the image field and images are formed. The actual color value and light intensity (brightness) of a given pixel location 532 may be an average of the color various light beams illuminating the pixel location during the scanning period. After completing a scanning period, the mirror 520 reverts back to the initial position to project light onto the first few rows of the image field 530 again, except that a new set of driving signals may be fed to the light emitters 410. The same process may be repeated as the mirror 520 rotates in cycles. As such, different images are formed in the scanning field 530 in different frames.

FIG. 5B is a conceptual diagram illustrating a waveguide configuration to form an image and replications of images that may be referred to as pupil replications, in accordance with an embodiment. In this embodiment, the light source of the display device may be separated into three different light emitter arrays 402, such as based on the configurations shown in FIGS. 4A and 4B. The primary colors may be red, green, and blue or another combination of other suitable primary colors. In one embodiment, the number of light emitters in each light emitter array 402 may be equal to the number of pixel locations an image field (not shown in FIG. 5B). As such, contrary to the embodiment shown in FIG. 5A that uses a scanning operation, each light emitter may be dedicated to generating images at a pixel location of the image field. In another embodiment, the configuration shown in FIGS. 5A and 5B may be combined. For example, the configuration shown in FIG. 5B may be located downstream of the configuration shown in FIG. 5A so that the image formed by the scanning operation in FIG. 5A may further be replicated to generate multiple replications.

The embodiments depicted in FIG. 5B may provide for the projection of many image replications (e.g., pupil replications) or decoupling a single image projection at a single point. Accordingly, additional embodiments of disclosed NEDs may provide for a single decoupling element. Outputting a single image toward the eyebox 230 may preserve the intensity of the coupled image light. Some embodiments that provide for decoupling at a single point may further provide for steering of the output image light. Such pupil-steering NEDs may further include systems for eye tracking to monitor a user's gaze. Some embodiments of the waveguide configurations that provide for pupil replication, as described herein, may provide for one-dimensional replication, while other embodiments may provide for two-dimensional replication. For simplicity, one-dimensional pupil replication is shown in FIG. 5B. Two-dimensional pupil replication may include directing light into and outside the plane of FIG. 5B. FIG. 5B is presented in a simplified format. The detected gaze of the user may be used to adjust the position and/or orientation of the light emitter arrays 402 individually or the light source 340 as a whole and/or to adjust the position and/or orientation of the waveguide configuration.

In FIG. 5B, a waveguide configuration 540 is disposed in cooperation with a light source 340, which may include one or more monochromatic light emitter arrays 402 secured to a support structure 564 (e.g., a printed circuit board or another structure). The support structure 564 may be coupled to the frame 105 of FIG. 1. The waveguide configuration 540 may be separated from the light source 340 by an air gap having a distance D1. The distance D1 may be in a range from approximately 50 μm to approximately 500 μm in some examples. The monochromatic image or images projected from the light source 340 may pass through the air gap toward the waveguide configuration 540. Any of the light source embodiments described herein may be utilized as the light source 340.

The waveguide configuration may include a single waveguide 542 or multiple waveguides 542, which may be formed from a glass or plastic material. The waveguide 542 may include a coupling area 544 and a decoupling area formed by decoupling elements 546A on a top surface 548A and decoupling elements 546B on a bottom surface 548B in some embodiments. The area within the waveguide 542 in between the decoupling elements 546A and 546B may be considered a propagation area 550, in which light images received from the light source 340 and coupled into the waveguide 542 by coupling elements included in the coupling area 544 may propagate laterally within the waveguide 542.

The coupling area 544 may include a coupling element 552 configured and dimensioned to couple light of a predetermined wavelength, e.g., red, green, or blue light. When a white light emitter array is included in the light source 340, the portion of the white light that falls in the predetermined wavelength may be coupled by each of the coupling elements 552. In some embodiments, the coupling elements 552 may be gratings, such as Bragg gratings, dimensioned to couple a predetermined wavelength of light. In some examples, the gratings of each coupling element 552 may exhibit a separation distance between gratings associated with the predetermined wavelength of light that the particular coupling element 552 is to couple into the waveguide 542, resulting in different grating separation distances for each coupling element 552. Accordingly, each coupling element 552 may couple a limited portion of the white light from the white light emitter array when included. In other examples, the grating separation distance may be the same for each coupling element 552. In some examples, coupling element 552 may be or include a multiplexed coupler.

As shown in FIG. 5B, a red image 560A, a blue image 560B, and a green image 560C may be coupled by the coupling elements of the coupling area 544 into the propagation area 550 and may begin traversing laterally within the waveguide 542. In one embodiment, the red image 560A, the blue image 560B, and the green image 560C, each represented by a different dash line in FIG. 5B, may converge to form an overall image that is represented by a solid line. For simplicity, FIG. 5B may show an image by a single arrow, but each arrow may represent an image field where the image is formed. In another embodiment, red image 560A, the blue image 560B, and the green image 560C, may correspond to different spatial locations. In various embodiments, one or more waveguides may be used. For example, in one embodiment, each monochromatic light emitter array 402 may project light to its respective waveguide in a larger waveguide stack that combines the three color channels. In another embodiment, two monochromatic light emitter arrays 402 may project light to a first waveguide and another monochromatic light emitter array 402 may project light to a second waveguide. The display device may include a third waveguide to converge the light of the three color channels. In other embodiments, other suitable combinations of waveguides and light projection arrangement may also be possible.

A portion of the light may be projected out of the waveguide 542 after the light contacts the decoupling element 546A for one-dimensional pupil replication, and after the light contacts both the decoupling element 546A and the decoupling element 546B for two-dimensional pupil replication. In two-dimensional pupil replication embodiments, the light may be projected out of the waveguide 542 at locations where the pattern of the decoupling element 546A intersects the pattern of the decoupling element 546B.

The portion of light that is not projected out of the waveguide 542 by the decoupling element 546A may be reflected off the decoupling element 546B. The decoupling element 546B may reflect all incident light back toward the decoupling element 546A, as depicted. Accordingly, the waveguide 542 may combine the red image 560A, the blue image 560B, and the green image 560C into a polychromatic image instance, which may be referred to as a pupil replication 562. The polychromatic pupil replication 562 may be projected toward the eyebox 230 of FIG. 2 and to the eye 220, which may interpret the pupil replication 562 as a full-color image (e.g., an image including colors in addition to red, green, and blue). The waveguide 542 may produce tens or hundreds of pupil replications 562 or may produce a single replication 562.

In some embodiments, the waveguide configuration may differ from the configuration shown in FIG. 5B. For example, the coupling area may be different. Rather than including gratings as coupling element 552, an alternate embodiment may include a prism that reflects and refracts received image light, directing it toward the decoupling element 706A. Also, while FIG. 5B generally shows the light source 340 having multiple light emitters arrays 402 coupled to the same support structure 564, other embodiments may employ a light source 340 with separate monochromatic emitters arrays 402 located at disparate locations about the waveguide configuration (e.g., one or more emitters arrays 402 located near a top surface of the waveguide configuration and one or more emitters arrays 402 located near a bottom surface of the waveguide configuration).

Also, although only three light emitter arrays are shown in FIG. 5B, an embodiment may include more or fewer light emitter arrays. For example, in one embodiment, a display device may include two red arrays, two green arrays, and two blue arrays. In one case, the extra set of emitter panels provides redundant light emitters for the same pixel location. In another case, one set of red, green, and blue panels is responsible for generating light corresponding to the most significant bits of a color dataset for a pixel location while another set of panels is responsible for generating light corresponding the least significant bits of the color dataset. The separation of most and least significant bits of a color dataset will be discussed in further detail below in FIG. 6.

While FIGS. 5A and 5B show different ways an image may be formed in a display device, the configurations shown in FIGS. 5A and 5B are not mutually exclusive. For example, in one embodiment, a display device may use both a rotating mirror and a waveguide to form an image and also to form multiple pupil replications.

Figure 5C:
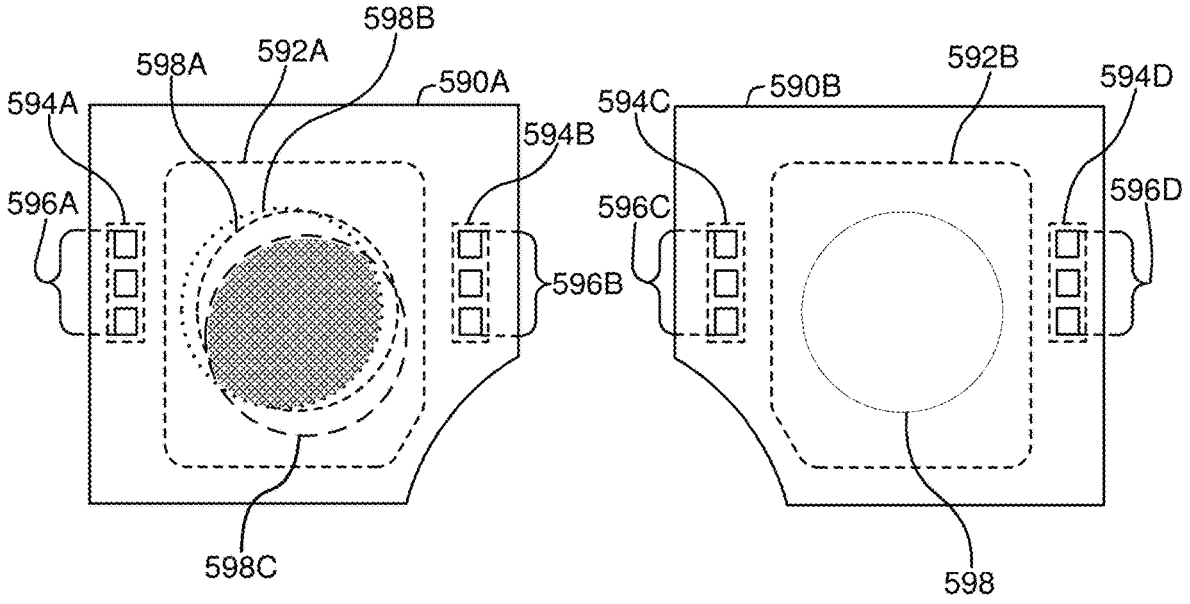
FIG. 5C is a top view of display device, in accordance with an embodiment.

FIG. 5C is a top view of a display system (e.g., an NED), in accordance with an embodiment. The NED 570 in FIG. 9A may include a pair of waveguide configurations. Each waveguide configuration projects images to an eye of a user. In some embodiments not shown in FIG. 5C, a single waveguide configuration that is sufficiently wide to project images to both eyes may be used. The waveguide configurations 590A and 590B may each include a decoupling area 592A or 592B. In order to provide images to an eye of the user through the waveguide configuration 590, multiple coupling areas 594 may be provided in a top surface of the waveguide of the waveguide configuration 590. The coupling areas 594A and 594B may include multiple coupling elements to interface with light images provided by a light emitter array set 596A and a light emitter array set 596B, respectively. Each of the light emitter array sets 596 may include a plurality of monochromatic light emitter arrays, as described herein. As shown, the light emitter array sets 596 may each include a red light emitter array, a green light emitter array, and a blue light emitter array. As described herein, some light emitter array sets may further include a white light emitter array or a light emitter array emitting some other color or combination of colors.

The right eye waveguide 590A may include one or more coupling areas 594A, 594B, 594C, and 594D (all or a portion of which may be referred to collectively as coupling areas 594) and a corresponding number of light emitter array sets 596A, 596B, 596C, and 596D (all or a portion of which may be referred to collectively as the light emitter array sets 596). Accordingly, while the depicted embodiment of the right eye waveguide 590A may include two coupling areas 594 and two light emitter array sets 596, other embodiments may include more or fewer. In some embodiments, the individual light emitter arrays of a light emitter array set may be disposed at different locations around a decoupling area. For example, the light emitter array set 596A may include a red light emitter array disposed along a left side of the decoupling area 592A, a green light emitter array disposed along the top side of the decoupling area 592A, and a blue light emitter array disposed along the right side of the decoupling area 592A. Accordingly, light emitter arrays of a light emitter array set may be disposed all together, in pairs, or individually, relative to a decoupling area.

The left eye waveguide 590B may include the same number and configuration of coupling areas 594 and light emitter array sets 596 as the right eye waveguide 590A, in some embodiments. In other embodiments, the left eye waveguide 590B and the right eye waveguide 590A may include different numbers and configurations (e.g., positions and orientations) of coupling areas 594 and light emitter array sets 596. Included in the depiction of the left waveguide 590A and the right waveguide 590B are different possible arrangements of pupil replication areas of the individual light emitter arrays included in one light emitter array set 596. In one embodiment, the pupil replication areas formed from different color light emitters may occupy different areas, as shown in the left waveguide 590A. For example, a red light emitter array of the light emitter array set 596 may produce pupil replications of a red image within the limited area 598A. A green light emitter array may produce pupil replications of a green image within the limited area 598B. A blue light emitter array may produce pupil replications of a blue image within the limited area 598C. Because the limited areas 598 may be different from one monochromatic light emitter array to another, only the overlapping portions of the limited areas 598 may be able to provide full-color pupil replication, projected toward the eyebox 230. In another embodiment, the pupil replication areas formed from different color light emitters may occupy the same space, as represented by a single solid-lined circle 598 in the right waveguide 590B.

In one embodiment, waveguide portions 590A and 590B may be connected by a bridge waveguide (not shown). The bridge waveguide may permit light from the light emitter array set 596A to propagate from the waveguide portion 590A into the waveguide portion 590B. Similarly, the bridge waveguide may permit light emitted from the light emitter array set 596B to propagate from the waveguide portion 590B into the waveguide portion 590A. In some embodiments, the bridge waveguide portion may not include any decoupling elements, such that all light totally internally reflects within the waveguide portion. In other embodiments, the bridge waveguide portion 590C may include a decoupling area. In some embodiments, the bridge waveguide may be used to obtain light from both waveguide portions 590A and 590B and couple the obtained light to a detector (e.g. a photodetector), such as to detect image misalignment between the waveguide portions 590A and 590B.

Driving Circuit Signal Modulations

The driving circuit 370 modulates color dataset signals that are outputted from the image processing unit 375 and provides different driving currents to individual light emitters of the light source 340. In various embodiments, different modulation schemes may be used to drive the light emitters.

Figure 6A:
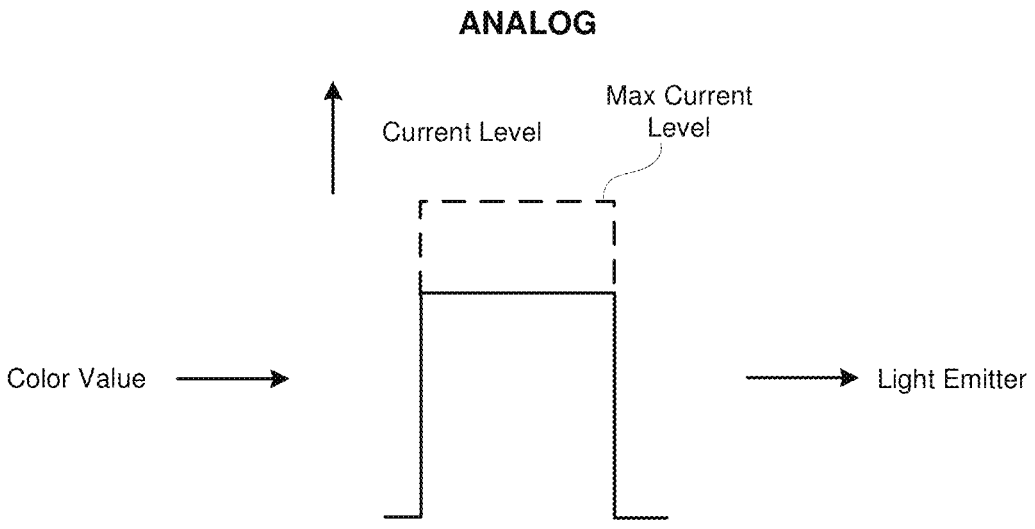
FIG. 6A is a waveform diagram illustrating the analog modulation of driving signals for a display panel, in accordance with an embodiment.

In one embodiment, the driving circuit 370 drives the light emitters using a modulation scheme that may be referred to as an "analog" modulation scheme in this disclosure. FIG. 6A is an illustrative diagram of the analog modulation scheme, in accordance with an embodiment. In the analog modulation scheme, the driving circuit 370 provides different levels of current to the light emitter, depending on the color value. The intensity of a light emitter can be adjusted based on the level of current provided to the light emitter. The current provided to the light emitter may be quantized into a pre-defined number of levels, such as 128 different levels, or, in some embodiments, may not be quantized. When the driving circuit 370 receives a color value, the driving circuit 370 adjusts the current provided to the light emitter to control the light intensity. For example, the overall color of a pixel location may be expressed as a color dataset that includes R, G, and B values. For the red light emitter, the driving circuit 370 provides a driving current based on the value of the R value. The higher the R value, the higher the current level is provided to the red light emitter, and vice versa. In total, the pixel location displays an additive color that is the sum of the R, G, and B values.

Figure 6B:
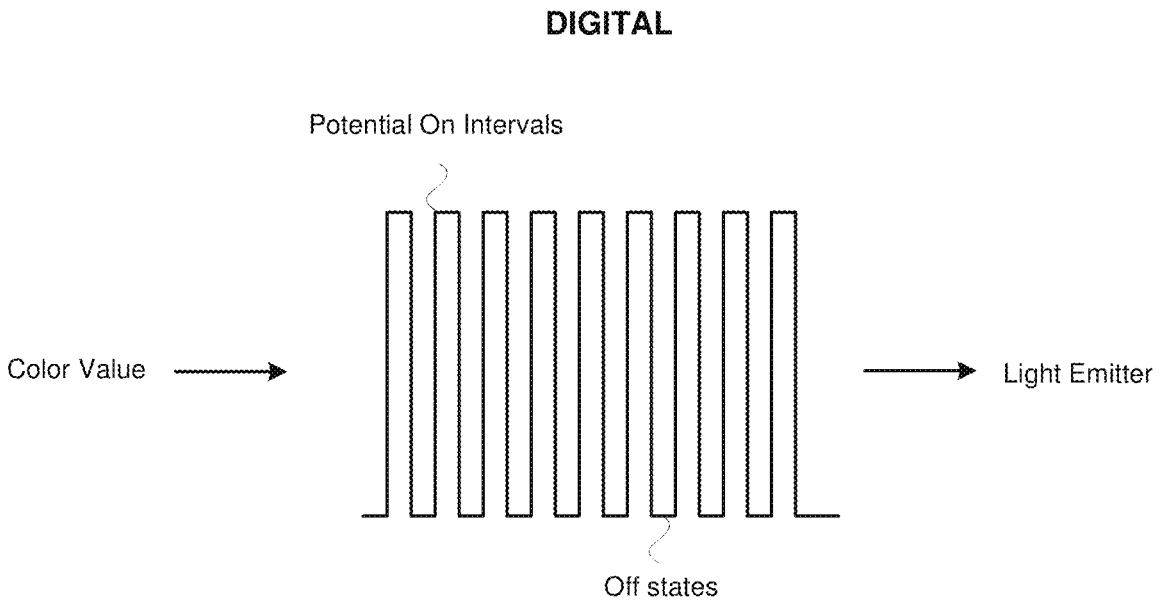
FIG. 6B is a waveform diagram illustrating the digital modulation of driving signals for a display panel, in accordance with an embodiment.

In another embodiment, the driving circuit 370 drives the light emitters using a modulation scheme that may be referred to as a "digital" modulation scheme in this disclosure. FIG. 6B is an illustrative diagram of the digital modulation scheme, in accordance with an embodiment. In the digital modulation scheme, the driving circuit 370 provides pulse width modulated (PWM) currents to drive the light emitters. The current level of the pulses is constant in a digital modulation scheme. The duty cycle of the driving current depends on the color value provided to the driving circuit. For example, when a color value for a light emitter is high, the duty cycle of the PWM driving current is also high compared to a driving current that corresponds to a low color value. In one case, the change in duty cycle can be managed through the number of potentially on intervals that are actually turned on. For example, in a display period (e.g., a frame), there may be 128 pulses sent to the light emitters. For a color value that corresponds to 42/128 of the intensity, 42 out of the 128 pulses (potential-on intervals) are turned on during the period. As such, from the perspective of a human user, the pixel location has an intensity of that color 42/128 of the maximum intensity.

In yet another embodiment, the driving circuit 370 drives the light emitters using a modulation scheme that may be referred to as a hybrid modulation scheme. In the hybrid modulation scheme, for each primary color, at least two light emitters are used to generate the color value at a pixel location. The first light emitter is provided with a PWM current at a high current level while the second light emitter is provided with a PWM current at a low current level. The hybrid modulation scheme includes some features from the analog modulation and other features from the digital modulation. The details of the hybrid modulation scheme are explained in FIG. 6C.

Figure 6C:
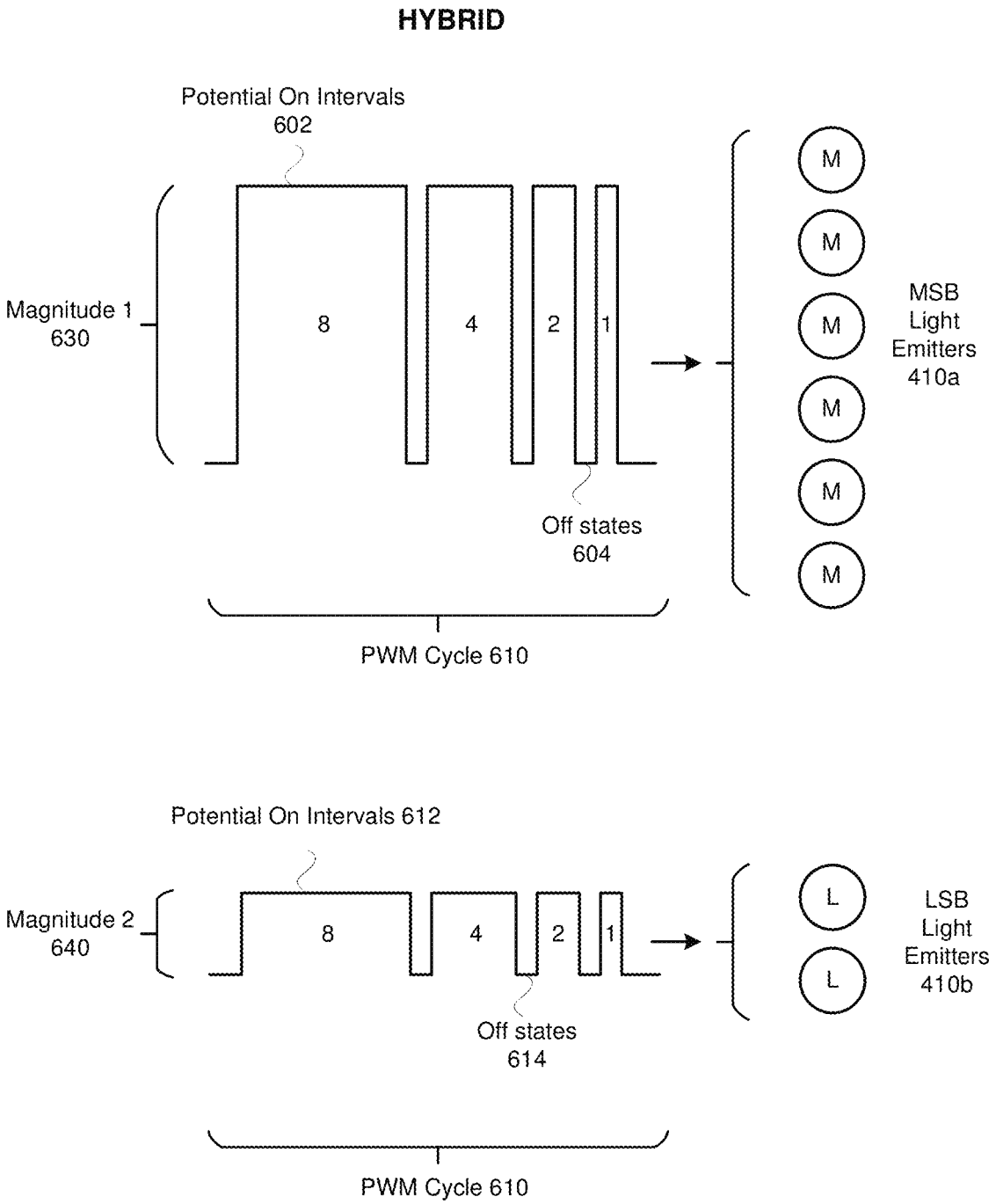
FIG. 6C is a waveform diagram illustrating the hybrid modulation of driving signals for a display panel, in accordance with an embodiment.

FIG. 6C is a conceptual diagram illustrating operations of two or more light emitters by the hybrid modulation, in accordance with an embodiment. For a primary color corresponding to a pixel location, a set of light emitters are separated into two or more sub-sets. In the example shown in FIG. 6C, the two subsets are the MSB light emitters 410*a* and the LSB light emitters 410*b*. The MSB light emitters 410*a* and the LSB light emitters 410*b* collectively generate a desired color value for a pixel location. The MSB light emitters 410*a* and LSB light emitters 410*b* are both driven by PWM signals. In a PWM cycle 610, there can be multiple discrete intervals of potential turn-on times. A turn-on time refers to a time interval in which current is supplied to a light emitter (i.e., when the light emitter is turned on). By the same token, an off-time or an off state refers to a time interval in which current is not supplied to a light emitter (i.e., when the light emitter is turned off). Whether a light emitter is really turned on in one of the potentially on-intervals 602 or 612 may depend on the actual bit value during the modulation. For example, if the actual bit value on which the modulation is based is 1001, the first and fourth potentially on-intervals are turned on and the second and third potentially on-intervals are turned off. In general, the larger the actual bit value represents, the longer is the turned-on times (i.e., more potentially on-intervals are turned on). The off states 604 and 614 are off intervals that respectively separate the potentially on-intervals 602 and the potentially on-intervals 612.

In a PWM cycle 610, there may be more than one potentially on-intervals and each potentially on-interval may be discrete (e.g., separated by an off state). Using PWM 1 modulation scheme in FIG. 6C as an example, the number of potentially on-intervals 602 may depend on the number bits in an MSB subset of bits on which the modulation is based. A color value (e.g., red=212) of an input pixel data may be represented in a binary form that has a number of bits (e.g., 212=11010100). The bits are separated into two subsets. The first subset may correspond to a MSB subset (1101). The number of potentially on-intervals 602 in a PWM cycle 610 may be equal to the number of bits in the MSB subset. For example, when the first 4 bits of an 8-bit input pixel data are classified as MSBs, there may be 4 potentially on-intervals 602, each separated by an off state 604, as shown in FIG. 6C. Likewise, the second subset may correspond to a LSB subset (0100).

The lengths of the potentially on-intervals 602 within a PWM cycle 610 may be different but proportional to each other. For example, in the example shown in FIG. 6, which may correspond to an implementation for 8-bit input pixel data, the first potentially on-interval 602 has 8 units of length, the second potentially on-interval 602 has 4 units of length, the third potentially on-interval 602 has 2 units of length, and the last potentially on-interval 602 has 1 unit of length. Each potentially on-interval 602 may be driven by the same current level. The lengths of intervals in this type of 8-4-2-1 scheme correspond to the bits of the subset MSBs or LSBs. For example, for MSBs that have 4 bits, the first bit is twice more significant than the second bit, the second bit is twice more significant than the third bit, and the third bit is twice more significant than the last bit. In total, the first bit is 8 times more significant than the last bit. Hence, the 8-4-2-1 scheme reflects the differences in significance among the bits. The order of potential on-intervals 8-4-2-1 is for example only and does not have to be ascending or descending. For example, the order may also be 1-2-4-8 or 2-8-1-4, etc.

The levels of current driving the MSB light emitters 410*a* and driving the LSB light emitters 410*b* are different, as shown by the difference in magnitudes in the first magnitude 630 and the second magnitude 640. The MSB light emitters 410*a* and the LSB light emitters 410*b* are driven with different current levels because the MSB light emitters 410*a* represent bit values that are more significant than those of the LSB light emitters 410*b*. In one embodiment, the current level driving the LSB light emitters 410*b* is a fraction of the current level driving the MSB light emitters 410*a*. The fraction is proportional to a ratio between the number of MSB light emitters 410*a* and the number of LSB light emitters 410*b*. For example, in an implementation of 8-bit input pixel data that has the MSB light emitters 410*a* three times more than the LSB light emitters 410*b* (e.g., 6 MSB emitters and 2 LSB emitters), a scale factor of 3/16 may be used (3 is based on the ratio). As a result, the perceived light intensity (e.g., brightness) of the MSB light emitters for the potentially on-intervals corresponds to the set [8, 4, 2, 1], while the perceived light intensity of the LSB light emitters corresponds to the set [8, 4, 2, 1]*(⅓ of the number)*(3/16 scale factor)=[½, ¼, ⅛, 1/16]. As such, the total levels of greyscale under this scheme is 2 to the power of 8 (i.e., 256 levels of greyscale).

The hybrid modulation allows a reduction of clock frequency of the driving cycle and, in turn, provides various benefits such as power saving. For more information on how this type of hybrid PWMs are used to operate a display device, U.S. patent application Ser. No. 16/260,804, filed on Jan. 29, 2019, entitled "Hybrid Pulse Width Modulation for Display Device" is hereby incorporated by reference for all purposes.

Color Shift of Light Emitters and Correction

Some types of light emitters are sensitive to the driving current levels. For example, in a VR system such as an HMD or a NED 100, for the display to deliver a high resolution while maintaining a compact size, microLEDs might be used in as the light emitters 410. However, microLEDs may exhibit color shifts at different driving current levels. Put differently, for microLEDs that are supposed to emit light of the same wavelength but different intensities when the driving currents are changed, a change in driving current additionally shifts the wavelength of the light. For instance, in FIG. 6C, even if the MSB light emitters 410*a* and the LSB light emitters 410*b* are identical microLEDs that are supposed to emit blue light of the same wavelength, the blue light emitted by the MSB light emitters 410*a* has a color shift compared to the blue light emitted by the LSB light emitters 410*b* because of the difference in driving current levels. This type of color shift is particularly severe in green and blue microLEDs. By the same token, in a display device that uses an analog modulation scheme, since different current levels are used to drive light emitters to generate different light intensities, the light emitters could also exhibit wavelength shift due to the change in current levels.

Figure 7A:
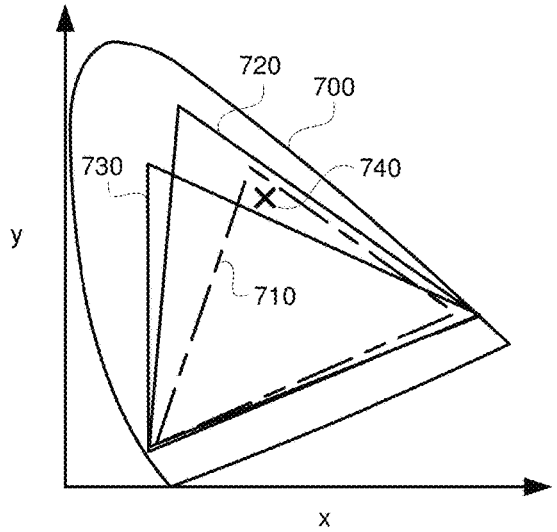
FIGS. 7A, 7B, and 7C are conceptual diagrams illustrating example color gamut regions in chromaticity diagrams.

FIG. 7A illustrates example color gamut regions shown in a CIE xy chromaticity diagram. FIG. 7A illustrates the color shifts of light emitters that are driven by different currents. The outer horseshoe-like shaped region 700 represents the range of all visible colors. The first color gamut 710, which is represented by a triangle in long-short dash lines in FIG. 7A, is the gamut for standard Red-Green-Blue (sRGB) color coordinate space. The sRGB color coordinate space is a standard color coordinate space that is widely used in many computers, printers, digital cameras, displays, etc. and is also used on the Internet to define color digitally. In order for a display device to be sufficiently versatile to display pixel data from various sources (e.g., images captured by digital cameras, video games, Internet web pages, etc.), the display device should be able to accurately display colors defined in the sRGB color coordinate space.

The second color gamut 720, which is represented by a solid lined triangle on the right in FIG. 7A, is the gamut generated by a display device using first light emitters that are driven by current at a first level. For example, the first light emitters can be a set of light emitters that include one or more red light emitters, one or more green light emitters, and one or more blue light emitters. In one case, the first light emitters may correspond to three sets of MSB light emitters 410*a* (e.g., 6 red MSB light emitters, 6 green MSB light emitters, and 6 blue MSB light emitters) shown in FIG. 6C. The three types of color light emitters collectively define the color gamut 720.

The third color gamut 730, which is represented by a solid lined triangle on the left in FIG. 7A, is the gamut generated by the display device using second light emitters that are driven by current at a second level that is lower than the first level of current. Similar to the first light emitters, the second light emitters can be a set of one or more red, green, blue light emitters. In some cases, structurally the second light emitters are the same or substantially similar light emitters of the first light emitters (e.g., the red light emitter in the second set is structurally the same or substantially similar to the red light emitter in the first set, etc.). However, since the second light emitters are driven at a second current level that is lower than the current level driving the first light emitters, the second light emitters exhibit color shifts and result in a gamut 730 that does not completely overlap with the gamut 720 of the first light emitters. The second light emitters may correspond to the LSB light emitters 410*b* shown in FIG. 6C (e.g., 2 red LSB light emitters, 2 green LSB light emitters, and 2 blue LSB light emitters). In one embodiment, the MSB light emitters of different colors are driven by the same first level of current while the LSB light emitters of different colors are driven by the same second level of current that is lower than the first level. In another embodiment, the driving current levels for the MSB light emitters of different colors are different, but each driving current level for the MSB light emitters of a color is higher than that of the LSB light emitters of the corresponding color.

Owing to discrepancy in the gamut 720 and the gamut 730, using the same signal that is generated by the same color coordinate to drive both the first light emitters and the second light emitters will result in a mismatch of color. This is because the perceived color is a linear combination of three primary colors (three vertices in the triangle) in a gamut. Since the coordinates of the vertices of the gamut 720 and gamut 730 are not the same, the same linear combination of primary color values does not result in the same actual color for gamut 720 and gamut 730. The mismatch of color could result in contouring and other forms of visual artifacts in the display device.

FIG. 7A also includes a point 740 representing a color coordinate that is marked by a cross. The point 740 represents a color in the sRGB color coordinate space that is not within the common color gamut that is common to the gamut 720 and the gamut 730. For example, the point 740 shown in FIG. 7A is outside of the gamut 730. Without proper color correction, colors similar to the one represented by the point 740 could be problematic to a display device that uses the hybrid or analog modulation schemes because the display device cannot properly deliver equivalent colors.

Figure 7B:
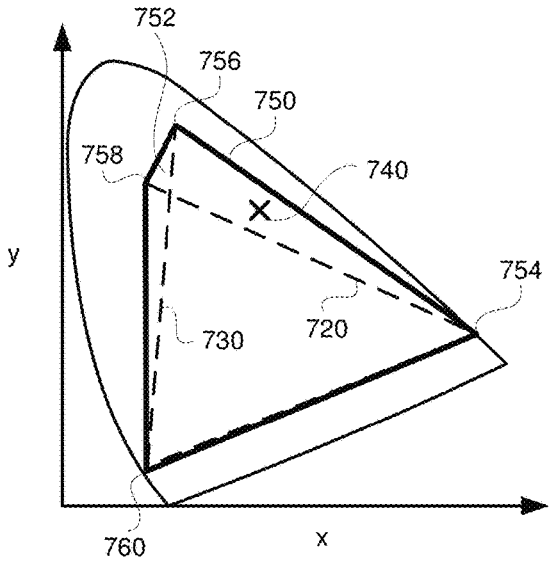

FIG. 7B illustrates an example color gamut 750 shown in the CIE xy chromaticity diagram, in accordance with an embodiment. The color gamut 750 is represented by a quadrilateral enclosed by a bolded solid line in FIG. 7B. The color gamut 750 represents the convex sum (e.g., a convex hull) of the vertices of the two triangular gamut regions 720 and 730 (corresponding to the gamut generated by the first light emitters and the gamut generated by the second light emitters), which are represented by dashed lines in FIG. 7B. The convex sum of the two triangular gamut regions 720 and 730 includes the union of the two gamut regions 720 and 730 and some extra regions such as region 752.

Colors in a display device are generated by an addition of primary colors (e.g., adding certain levels of red, green, blue light together) that correspond to the vertices of a polygon defining the gamut. As such, the quadrilateral gamut 750 involves four different primary colors to define the region. A display device generating the quadrilateral gamut 750 includes four primary light emitters that emit light of different wavelengths. Since the color shift in green light is most pronounced, the four primary colors that generate the quadrilateral gamut 750 are red, first green, second green, and blue, which are respectively represented by vertices 754, 756, 758, and 760. The first green 756 may correspond to light emitted by one or more green MSB light emitters while the second green 758 may correspond to light emitted by one or more green LSB light emitters.

Since the quadrilateral gamut 750 includes the union of the gamut 720 and gamut 730, the quadrilateral gamut 750 covers the entire region of sRGB gamut 710, as shown in FIG. 7A. Hence, a display device that uses the hybrid modulation schemes may use four primary color light emitters to generate the quadrilateral gamut 750 to address the issue of color shift. The colors in the quadrilateral gamut 750 can be expressed as linear combinations of the four primary colors.

Figure 7C:
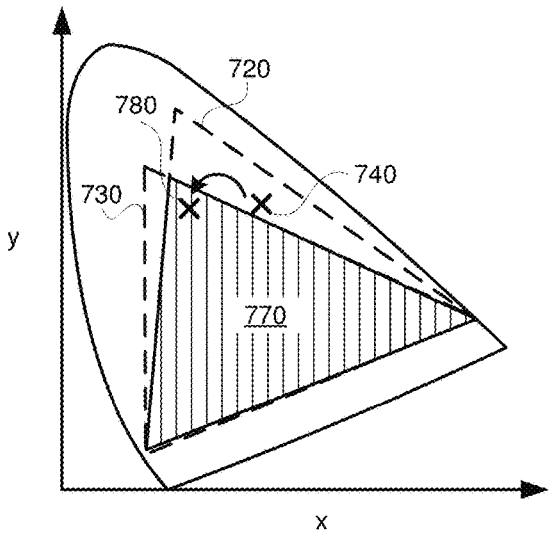

FIG. 7C illustrates another example color gamut 770 shown in the CIE xy chromaticity diagram, in accordance with an embodiment. The color gamut 770 is represented by a hashed triangle in FIG. 7C. The color gamut 770 represents a common color gamut that is common to the color gamut 720 (which corresponds to the first light emitters) and the color gamut 730 (which corresponds to the second light emitters). In other words, the color gamut 770 may be the intersection of the color gamut 720 and the color gamut 730. Since the color gamut 770 is shared by the color gamut 720 and color gamut 730, any light having a color coordinate that falls within the common color gamut 770 can be generated by the first light emitters and the second light emitters. A conversion can be made to convert an original color coordinate (such as the point 740) that is beyond the common color gamut 770 to an updated color coordinate (such as the point 780) that is within the common color gamut 770 according to a mapping scheme, such as a linear transformation operation or a predetermined look-up table. As such, input pixel data that represents a color value in an original color coordinate (such as a color coordinate in the sRGB color coordinate space) can be converted to an updated color coordinate that is within the common color gamut 770. The update color coordinate can be simply adjusted for the color gamut 720 and for the color gamut 730 for the respective generation of driving signals. This type of conversion process accounts for the color shift of the light emitters due to the differences in the driving current levels. Hence, color values in an original color coordinate space (such as sRGB) can be produced by a display device that uses the hybrid modulation schemes.

By way of an example, a color dataset may include three primary color values to define a coordinate at the CIE xy chromaticity diagram. The color dataset may represent a color intended to be displayed at a pixel location. The color dataset may define a coordinate that may or may not fall within the common color gamut 770. In response to the coordinate falling outside the common color gamut 770 (e.g., the coordinate represented by point 740), an image processing unit may perform a constant-hue mapping to map the coordinate to another point 780 that is within the common color gamut 770. If the coordinate is within the common color gamut 770, the constant-hue mapping may be skipped.

After the image processing unit of the display device determines that the coordinate is within the common color gamut 770, the generation of an output color dataset may depend on the modulation scheme used by the display panel 380. For example, in an analog modulation scheme, a look-up table may be used to determine the actual color values that should be provided to the driving circuit. The look-up table may account for the continuous color shift of the light emitters due to different driving current levels and pre-adjusted the color values to compensate for the color shift.

In a hybrid modulation scheme, the coordinate within the common color gamut 770 may first be separated into MSBs and LSBs. An MSB correction matrix may be used to account for the color shift of the MSB light emitters while an LSB correction matrix may be used to account for the color shift of the LSB light emitters. By way of a specific example, each output color coordinate may include a set of RBG values (e.g., red=214, green=142, blue=023). The output color coordinate for the MSB light emitters is often different from the output color coordinate for the LSB light emitters because the color shift is accounted. As such, the MSB light emitters and the LSB light emitters are made to agree by accounting for the color shift and correcting the output color coordinates. The color coordinate can be multiplied by an MSB correction matrix to generate an output MSB color coordinate. Likewise, the same updated color coordinate can be multiplied by an LSB correction matrix to generate an output LSB color coordinate.

For more information on how the color shift is corrected in a display device, U.S. patent application Ser. No. 16/260,847, filed on Jan. 29, 2019, entitled "Color Shift Correct for Display Device" is hereby incorporated by reference for all purposes.

Image Processing Unit

Figure 8:
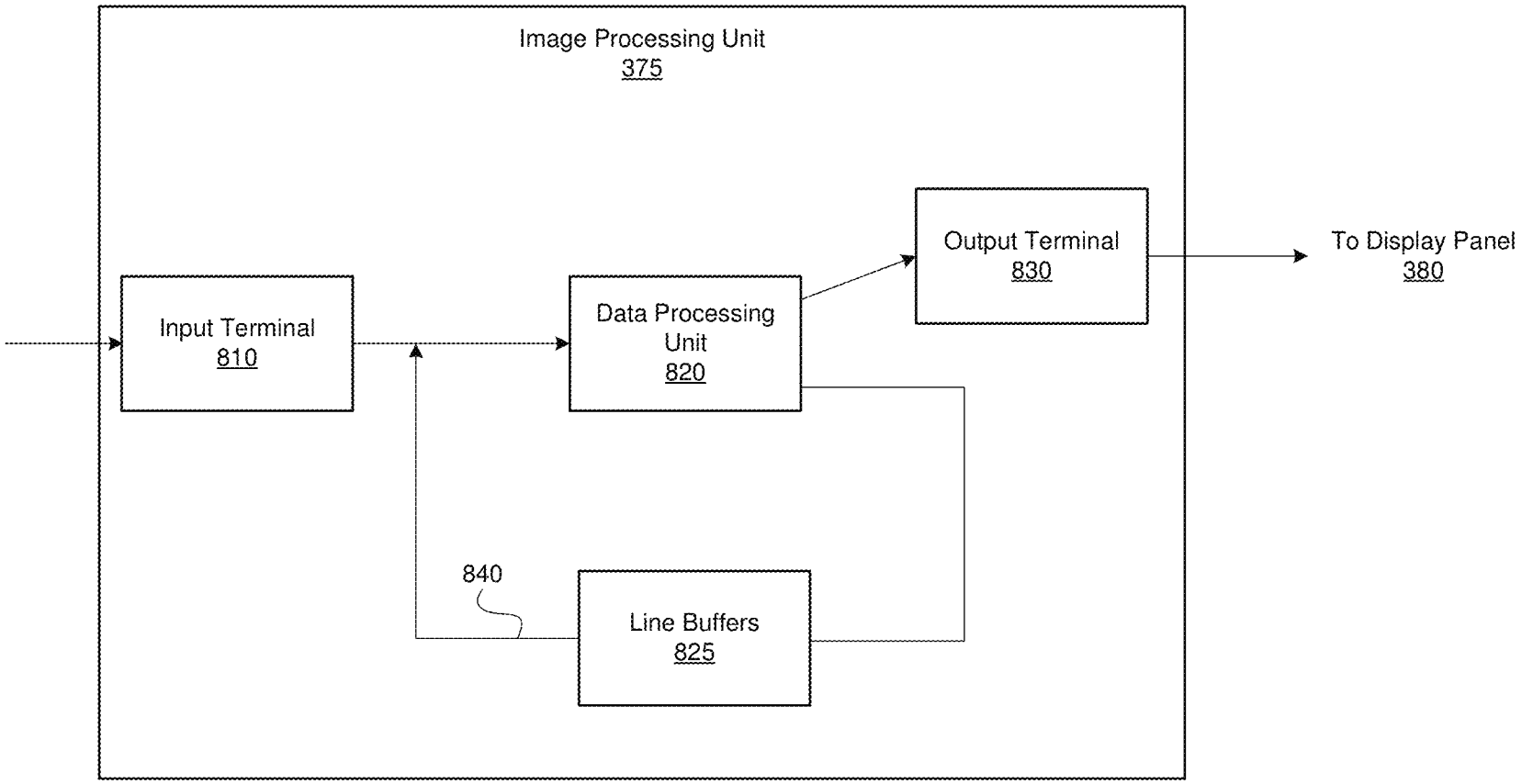
FIG. 8 is a block diagram depicting an image processing unit, in accordance with some embodiments.

FIG. 8 is a block diagram illustrating an image processing unit 375 of a display device, in accordance with an embodiment. The image processing unit 375 may include, among other components, an input terminal 810, a data processing unit 820, and an output terminal 830. The image processing unit 375 may also include line buffers 825 to stores calculated results. The image processing unit 375 may also include additional or fewer components.

The input terminal 810 receives input color datasets for different pixel locations. Each of the input color datasets may represent a color value intended to be displayed at a corresponding pixel location. The input color datasets may be sent from a data source, such as the controller 330, a graphics processing unit (GUI), an image source, or remotely from an external device such as a computer or a gaming console. An input color dataset may specify the color value of a pixel location at a given time in the form of one or more primary color values. For instance, the input color dataset may be an input color triple that includes values of three primary colors (e.g., R=123, G=23, B=222). The three primary colors may not necessarily be red, green, and blue. The input color dataset may also be other color systems such as YCbCr, etc. The color dataset may also include more than three primary colors.

The output terminal 830 is connected to the display panel 380 and provides output color datasets in the form of signals to the display panel 380. The display panel 380 may include the driving circuit 370 and the light source 340 (shown in FIG. 3B) that includes a plurality of light emitters. The display panel 380 may use the configuration shown in FIG. 5A or FIG. 5B. In the display panel 380, the output color datasets are modulated by the driving circuit 370 to provide the appropriate driving current to one or more light emitters. For display panel 380 that uses a hybrid modulation, an output color dataset may include sub-datasets for driving different sets of light emitters (e.g., a set of low current light emitters and a set of high current light emitters) that cooperate to generate color at a pixel location. For example, a first output color sub-dataset includes different color bit values that represent the MSBs of the output color values while a second output color sub-dataset includes bit values that represent the LSBs of the output color values. Each output color sub-dataset may include RGB values with the R value being modulated and converted to driving current to drive one or more red light emitters. Likewise, the G and B values are modulated and converted to driving currents to drive one or more green light emitters and one or more blue light emitters, respectively.

The data processing unit 820 converts the input color datasets to the output color datasets. Each of the output color datasets may include multiple sub-datasets. The output color datasets include the actual data values used to drive the light emitters. An output color dataset often has values that are similar to the corresponding input color dataset but are often not identical. One reason why output color datasets may be different from the input color datasets is because the light emitters are often subject to one or more operating constraints. The operating constraints (e.g., hardware limitations, color shift, etc.) prevent the light emitters from emitting the intended colors using the values specified in the input color datasets directly. In addition, the data processing unit 820 may also perform other color compensation and warping for the perception of the human users that may also change the output color datasets. For example, color compensation may be performed based on user settings to make the images appear to be warmer, more vivid, more dynamic, etc. Color compensation may also be performed to account for any curvature or other unique dimensions for HMID or NED 100 so that raw data of a flat image may appear more similar to the reality from the perception of the human users.

The one or more operating constraints of the light emitters and display panel may include any hardware limitations, color shifts, design constraints, physical requirements and other factors that render the light emitters unable to precisely produce the color specified in the input color dataset.

A first example of operating constraint is related to a limitation of bit depth of the light emitters or the display panel. Because of a limited bit depth, the intensity levels of the light emitters may need to be quantized. Put differently, a light emitter may only be able to emit light at a predefined number of different intensities. For example, in a hybrid PWM, each pulse period cannot be infinitely small so that only a predefined number of periods can be fit in a display period. On the other hand, the input color dataset may be specified in a fineness of color that is higher than the hardware of the light emitter is able to produce (e.g., a 10-bit input bit depth versus an 8-bit light emitter). Hence, the data processing unit 820, in generating the output color datasets, may need to quantize the input color datasets.

A second example of operating constraint may be related to the color shift of the light emitters. The wavelengths of the light emitted by some light emitters may shift because of changes in conditions of the light emitters. For example, as discussed above in FIGS. 7A-7C, some light emitters such as microLEDs may exhibit a color shift when the light emitters are driven by different levels of currents. In generating the output color datasets, the data processing unit 820 may account for the color shift to adjust the input color datasets.

A third example of operating constraint may be related to the design of the display panel 380. For example, in a hybrid modulation, the color values in the input color dataset are split into MSBs and LSBs. The MSBs are used to drive a first set of light emitters at a first current level. The LSBs are used to drive a second set of light emitters at a second current level. Because of the difference in driving current levels, the two subsets of light emitters may exhibit a color shift relative to each other. In generating the output color datasets, the data processing unit 820 may split the input color datasets into two sub-datasets (for the MSBs and the LSBs) and treat each sub-dataset differently.

A fourth example of operating constraint may be related to various defects or non-uniformities presented in the display device that could affect the image quality of the display device. In one embodiment, a plurality of light emitters of the same color are responsible for emitting a primary color of light for a single pixel location. For example, as shown in FIG. 6C, six MSB light emitters 410*a* of the same color may responsible for a single pixel location. While the light emitters are supposed to be substantially identical, the light emitters driven at the same level of current may produce light at a different light intensity within manufacturing tolerance or due to manufacturing defects or other reasons. In some cases, one or more light emitters in the plurality of light emitters may be completely defective. The waveguide used to direct images may also exhibit a certain degree of non-uniformity that might affect the image quality. In generating the output color datasets, the data processing unit 820 may account for various causes of non-uniformity that might affect how the output color datasets are generated.

While four examples of operating constraints are discussed here, there may be more operating constraints, depending on the type of light emitters, the circuit design of the driving circuit 370, the modulation scheme, and other design considerations. In light of one or more operating constraints, the data processing unit 820 converts the input color datasets to output color datasets, which are transmitted at the output terminal 830 to the display panel 380.

Since the output color datasets are adjusted from the input color datasets, the input color and the rendered output color may differ. The data processing unit 820 accounts for errors in the output color datasets and compensate for the errors. By way of example, the data processing unit 820 determines a difference between a version of an input color dataset and a version of the corresponding output color dataset. Based on the difference, the data processing unit 820 determines one or more error correction datasets, each of which may include a set of compensation values that are used to adjusted colors of another pixel location. The error correction datasets are fed back into the input side of the data processing unit 820, as indicated by the feedback line 840. The data processing unit 820 uses the values in the error correction datasets to dither one or more other input color datasets that are incoming at the input terminal 810 and that are subsequent to the current input color dataset. Some of the values in the error correction dataset may be stored in one or more line buffers and may be used to dither other input color datasets that may be received at the image processing unit 375 at a later time.

Error correction datasets generated by a first pixel location are used to dither other input color datasets that correspond to the nearby pixels. By way of a simple example, because of various operating constraints of the light emitters, the first pixel location may display a color that is redder than the intended color value. This error may be compensated by dithering the neighboring pixels (e.g., by slightly reducing the red color of the neighboring pixels). This process is represented by the feedback loop 840 that uses the error correction dataset to adjust the next input color dataset. Nearby pixel locations are pixel locations that are in proximity of the first pixel location. Nearby pixel locations may be pixel locations that are within a predetermined distance from the first pixel location. For example, the nearby pixel locations may include pixel locations that are immediately adjacent to the first pixel location and pixel locations that are at the diagonal positions of the first pixel location. In some embodiments, the nearby pixel locations may be separated from the first pixel location by three or more pixels. In some embodiments, the nearby pixel locations may be defined in light of an image kernel that generates the error correction datasets. For example, the image kernel may include a 5×5 matrix. In such a case, the nearby pixel locations may include pixel locations that are five pixels apart from the first pixel location.

In one embodiment, the image processing unit 375 may process color datasets sequentially for each pixel location or for groups of pixel locations. For example, the pixel locations in an image field are arranged by rows and columns. A first input color dataset for a first pixel location in a row may be processed first. The image processing unit 375 generates, from the first input color dataset, two output color sub-datasets for driving a first set of light emitters and a first set of light emitters, both of which emit light for the first pixel location but are driven at different current levels. The image processing unit 375, in turn, determines error correction datasets that are derived from the input color dataset and the output color sub-datasets. The error correction datasets are fed back by the feedback loop 840 to the input side for a subsequent input color dataset. When the image processing unit 375 receives a second input color dataset for a second pixel location which can be one of the nearby pixel locations, the image processing unit 375 uses one of the error correction datasets to adjust the second input color dataset. The second pixel location may be located in the same row or the next row of the first pixel location. In one embodiment, the error from a first pixel in a first row may be propagated and spread to a plurality of pixels in the next row, such as the pixel that is immediately adjacent to the first pixel (i.e., the pixel that is in the same column of the first pixel) and two pixels in the next row that are diagonal to the first pixel. The image processing unit 375 may process datasets row by row to simplify the hardware and circuit. The values in the error correction datasets for dithering the datasets for next row are stored in the line buffers 825.

In one embodiment, the image processing unit 375 may include multiple groups of components 810, 820, 825, and 830 (e.g., repetitions of arrangements shown in FIG. 8) for parallel processing. For example, data for multiple rows of pixel locations may be processed in parallel simultaneously. In such an arrangement, the line buffers in one group of components may provide the values of the error correction dataset to other groups of components.

Figure 9:
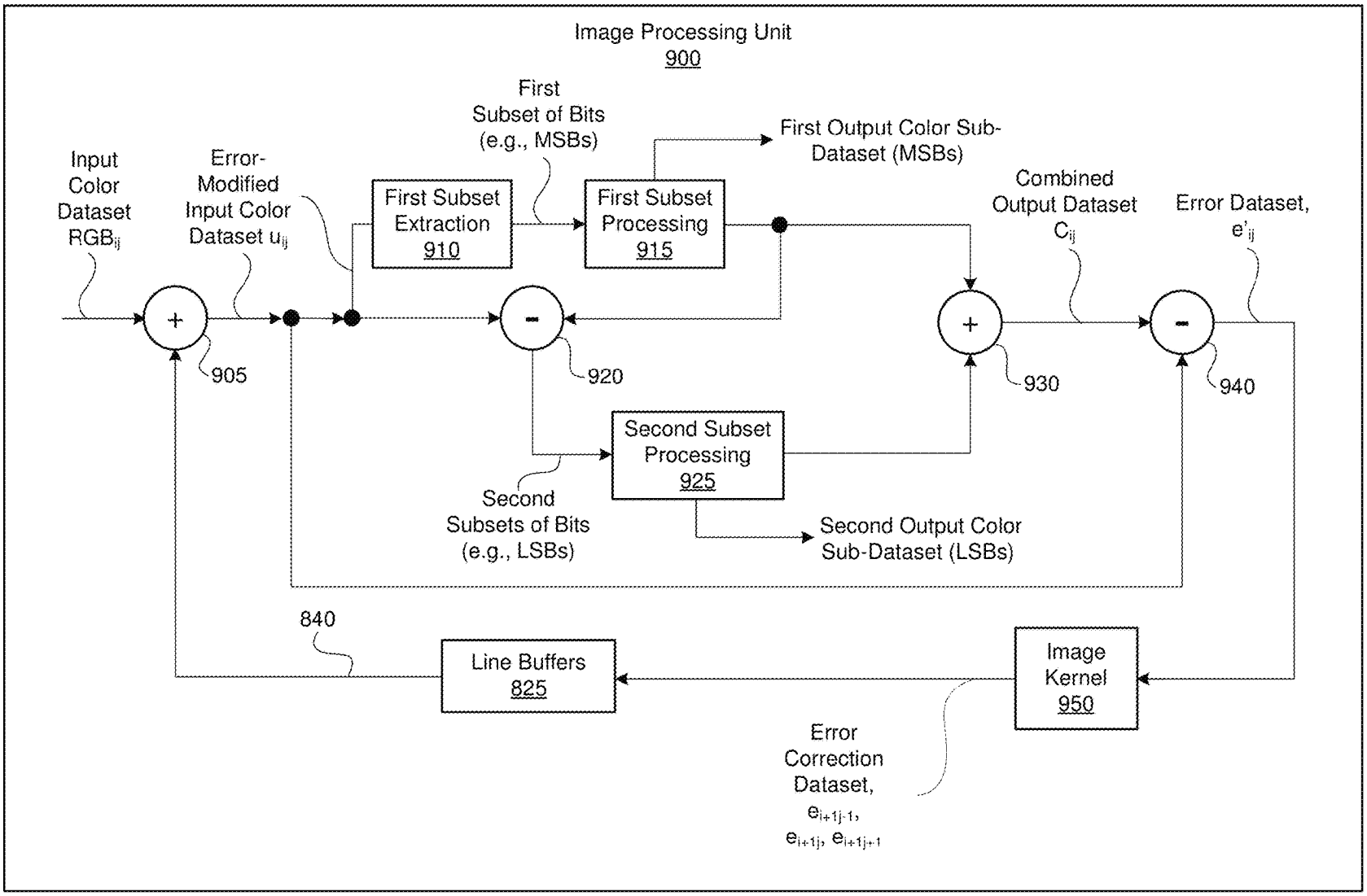
FIG. 9 is a schematic block diagram an image processing unit of a display device, in accordance with an embodiment.
Figure 10:
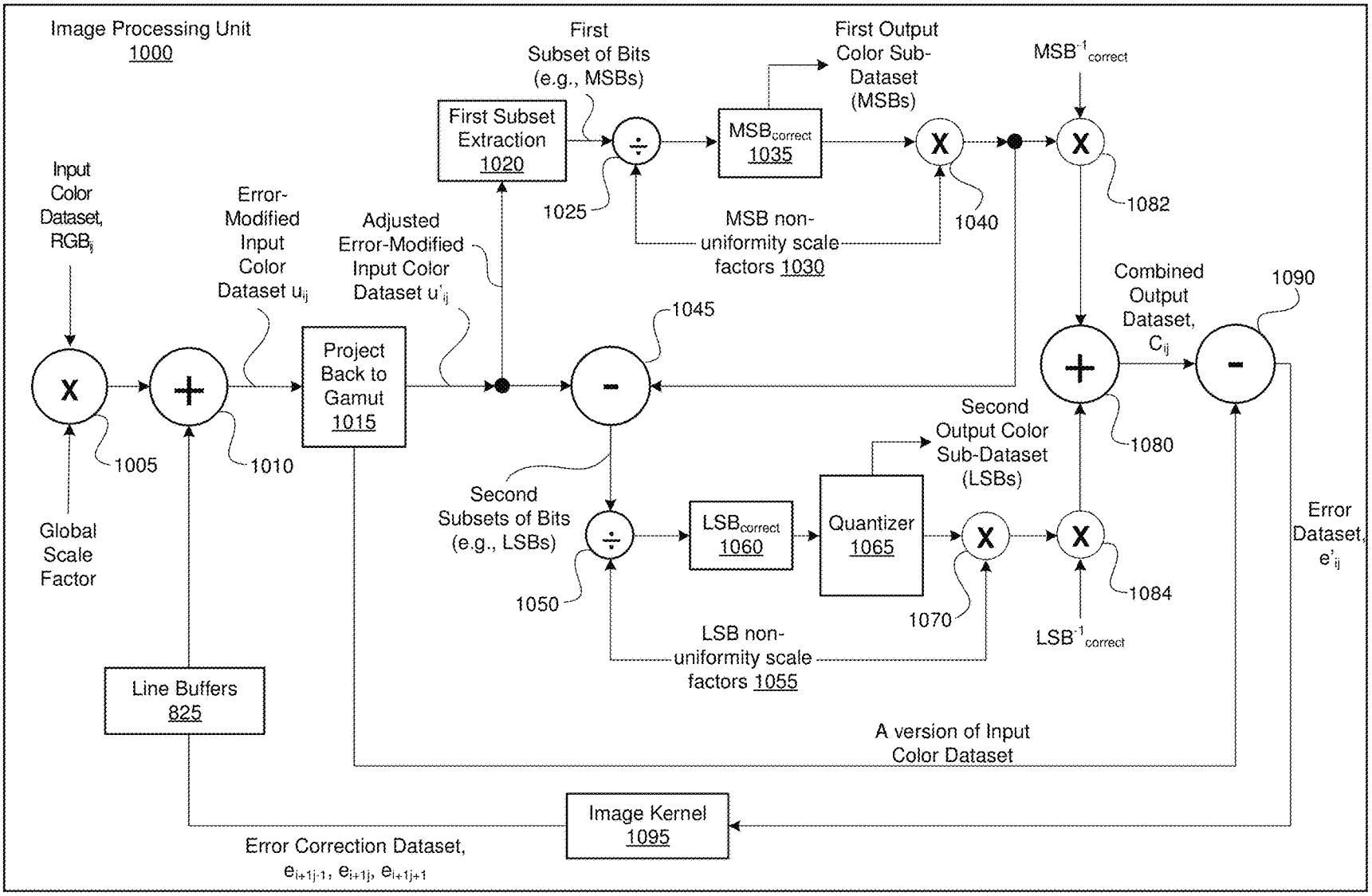
FIG. 10 is a schematic block diagram an image processing unit of a display device, in accordance with an embodiment.

FIGS. 9 and 10 are schematic block diagrams illustrating various implementations of image processing units 375, in accordance with some embodiments. Each schematic block diagram may be implemented as a software algorithm that is stored in a computer readable medium such as a memory and executable by a processor (e.g., a GPU), as hardware circuit blocks using logic gates and registers (e.g., a specialized image signal processor), or as a mix of software and hardware functional blocks. In FIGS. 9 and 10, various data values are denoted as different symbols for the ease of reference only but should not be construed as limiting. For example, while the input color dataset is denoted as $RGB_{ij}$, this does not mean that, in various embodiments described herein, the input color dataset has to be expressed in RGB color space or that the input color dataset has only three primary colors. Also, any of the blocks and arrows in those figures may be implemented as a circuit, software, or firmware, even if this disclosure does not explicitly specify so.

Image Processing Unit—Hybrid Modulation

FIG. 9 is a schematic block diagram of an example image processing unit 900 that may be used with a display panel 380 that uses hybrid modulation scheme, according to one embodiment. As an overview, the image processing unit 900 shown in FIG. 9 processes a first subset of bits in an input color dataset to generate a first output color sub-dataset for a pixel location, determines a second subset of bits that are derived from a difference between the input color dataset and the first output color sub-dataset, and generates a second output color sub-dataset for the pixel location. In one embodiment, the first and second subset of bits may respectively be most significant bits and least significant bits. The first and second output color sub-datasets may be combined to determine combined values that represent a color value of the pixel location. The combined values are compared to the input color dataset to determine the error between the actual color displayed at the pixel location and the desired color specified by the input. The error is processed by a dither algorithm to generate error correction datasets that are fed back to subsequent input color datasets for other pixel locations to compensate for the error.

By way of example, at a certain point in time, the image processing unit 900 receives a first input color dataset $RGB_{ij}$ for a first pixel location at row i and column j. The first input color dataset may represent a color value intended to be displayed at a first pixel location ij. The input color dataset may take the form of a barycentric weight of the primary colors (e.g., R=798, G=148, B=525 in a 10-bit scale). The term "first" used here is merely a reference number and does not require the first pixel location to be the very first pixel location in the image field. The first input color dataset $RGB_{ij}$ is added at the addition block 905 with the error correction values of an error correction dataset that are determined from one or more pixel locations that are nearby processed before the first pixel location. For example, the error correction dataset for the first pixel location may be derived from combining some of the error correction values of the pixel location adjacent to the first pixel location in the preceding row and the same column (i.e., pixel location i−1j) and the error correction values of two pixel locations that are diagonal to the first pixel location (i.e., pixel locations i−1j−1, and i−1j+1). The addition block 905 may be a circuit, software, or firmware. After adjusting the first input color dataset $RGB_{ij}$ with the error correction values, a first error-modified input color dataset $u_{ij}$ is generated. The first error-modified input color dataset $u_{ij}$ is a version of the input color dataset and may also simply be referred to as the input color dataset.

At first subset extraction block 910, the image processing unit 900 extracts a first subset of bits in the first input color dataset (e.g., the first error-modified input color dataset $u_{ij}$). In one embodiment, the first subset of bits may include the MSBs. For example, the first input color dataset may include the values R=798, G=148, and B=525. The red color value may be expressed in a binary form 1000011110. The image processing unit 900 may extract the first 5 bits as the MSBs. Hence, 10000 is extracted from the first input color dataset as the first subset of bits. The image processing unit 900 also performs similar extractions for the green and blue color values.

At a first subset processing block 915, the image processing unit 900 processes the first subset of bits to generate a first output color sub-dataset for driving a first set of light emitters (not shown in FIG. 9) that emit light to be projected to the first pixel location. In some embodiments, the first subset processing block 915 is bypassed and the image adjustment is performed on only the LSBs. The processing may include one or more adjustment, such as for color shifting and for non-uniformity. The first subset processing block 915 may adjust the first subset of bits to compensate for shifts of the color of the first set of light emitters. For example, the first subset processing block 915 may include one or more look-up tables or transformation matrices that adjust for the color shift of the first set of light emitters. The first subset processing block 915 may also scale the MSB sub-dataset to compensate for non-uniformity, described below in detail with reference to FIG. 10. The output of the first subset processing block 915 is a first output color sub-dataset that may include adjusted MSB values used to drive the first set of light emitters in a hybrid modulation.

At a subtraction block 920, the image processing unit 900 generates a second subset of bits. In one embodiment, the second subset of bits may include LSBs. The second subset of bits is derived from a difference between the first output color sub-dataset and the input color dataset. For example, for the input red color value of 798 (i.e., 1000011110), the MSBs extracted may be 10000 while the adjusted MSBs in the first output color sub-dataset may be 10001. The image processing unit 900 may determine the LSBs for the second subset of bits by determining the difference between 1000011110 (i.e., the value in the input color dataset) and 1000100000 (i.e., the value represented by the MSBs in the first output color sub-dataset with zeros added to the end). The difference represents the color value that still need to be rendered at the first pixel location to generate the precise desired color. The second subset of bits may also include LSBs for other colors such as green and blue. In some embodiments, the first and second subsets of bits may not need to evenly divide a value. For example, in one embodiment, the image processing unit 900 may extract the first 4 bits as the first subset of bits for a 10-bit input value.

At a second subset processing block 925, the image processing unit 900 processes the second subset of bits to generate a second output color sub-dataset for driving a second set of light emitters (not shown in FIG. 9). The first set of light emitters (e.g., MSB light emitters) and the second set of light emitters (e.g., LSB light emitters) may generate light that is projected to the same pixel location. The processing of the second subset of bits may include one or more adjustment, such as for color shifting and for non-uniformity. In one embodiment, the second subset processing block 925 may adjust the second subset of bits to compensate for shifts of color of the second set of light emitters. For example, the second subset processing block 925 may include one or more look-up tables or transformation matrices that adjust for the color shift of the second set of light emitters. The second subset processing block 925 may also scale the second subset of bits to compensate for non-uniformity.

The data processing for the second subset of bits may also include quantization to reduce the bit depth of the LSBs. For example, each of the values in the input color dataset, which represent the desired color, may be in 10 bits while the hardware in the display panel 380 may only support 8 bits, which may be divided as 4-bit MSBs and 4-bit LSBs. At node 910, the image processing unit 900 may extract the first 4 bits in the input data value for the MSB sub-dataset. As such, the values in the second subset of bits may be in 6 bits while the second set of the light emitters may only support 4 bits. Hence, the image processing unit 900 quantizes the second subset of bits so that the second output color sub-dataset is in the bit depth of the second set of light emitters.

After various adjustment and quantization operation, the output of the second subset processing block 925 is the second output color sub-dataset that includes adjusted LSB values used to drive the second set of light emitters in a hybrid PWM. Any error resulted from the adjustment and quantization may be compensated by subsequent pixel locations using dithering.

The dithering may be performed by first determining a difference between the desired color and the actual color displayed at the first pixel location. At a block 930, the image processing unit 900 combines the first and second color output sub-datasets to generate a combined output dataset $C_{ij}$ that represents the color displayed at the first pixel location. At a subtraction block 940, the image processing unit 900 determines an error dataset $e'_{ij}$, which represents differences between the input color dataset (e.g., the error-modified input color dataset) and the combined output dataset. The error represents the difference between the actual color displayed and the desired color at the pixel location.

The error dataset $e'_{ij}$ is used to pass through an image kernel 950, which is a circuit, software, or firmware that generates error correction datasets (e.g., $e_{i+1j-1}$, $e_{i+1j}$, $e_{i+1j+1}$) by applying a dither algorithm. Each of the error correction datasets is fed back for adjusting values of a pixel location that is in a proximity of the first pixel location (e.g., a pixel location that is within a predetermined distance from the first pixel location). Each error correction dataset represents a compensation of color error resulting from a difference between the input color dataset and the output color dataset. Since the error dataset $e'_{ij}$ is a difference of a version of an output and a version of the input, the error dataset $e'_{ij}$ is specific to a pixel location. In one embodiment, the compensation of the error may be achieved through adjusting nearby pixel locations so that, on a spatial average, the error at the pixel location is hardly perceivable by human eyes.

By way of example, after the error dataset $e'_{ij}$ that corresponds to the first pixel location is generated, the image kernel 950 generates error correction datasets $e_{i+1j-1}$, $e_{i+1j}$, and $e_{i+1j+1}$, which include error compensation values for pixel locations in the next row. Each of the error compensation datasets $e_{i+1j-1}$, $e_{i+1j}$, and $e_{i+1j+1}$ may be combined with other error compensation datasets that also affect a particular pixel location. For example, a pixel location at row i+1 and column j may be affected by the error compensation datasets generated from the pixel locations at ij−1, ij, and ij+1. The error compensation datasets are stored in line buffers 825 and are fed back to the input side of the image processing unit 900 through feedback line 840. When processing image data for the next row of pixel locations, the image processing unit 900 receives a second input color dataset for a second pixel location, which is one of the nearby pixel locations of the first pixel location. The image processing unit 900 adjusts, based on the values in the error correction dataset, the second input color dataset at the addition block 905. The adjustment may be a direct addition or some variations of addition. The process described may be repeated for the second input color dataset.

The image kernel 950 may include a dither algorithm that converts error dataset for a pixel location to different error correction datasets for multiple neighboring pixel locations. The image kernel 950 is designed to proportionality and/or systematically to spread the error compensation values across one or more pixel locations. In one embodiment, the image kernel 950 includes a Floyd-Steinberg dithering algorithm to spread the error to multiple locations. The image kernel 950 may also include an algorithm that uses other image processing techniques such as a mask-based dithering, discrete Fourier transform, convolution, etc.

Each block in FIG. 9 may be implemented as software or hardware. In an embodiment where the image processing unit is a circuit, each of the blocks 905-950 may be circuits that have the configuration to perform specific tasks. In such an embodiment, the circuit for first subset processing 915 may be located upstream of the subtraction block 920 and the second subset processing 925. The sequential processing of the MSBs then LSBs allows a better estimation of desired color value to be displayed because the precise color value often depends on the precision of the LSBs. Any overflow of the LSBs may be clipped and the clipped values may be regarded as part of the error that will be compensated by dithering. The sequential processing of MSBs and LSBs also allows a simplification of hardware because the MSBs and LSBs do not affect each other in parallel. Also, by processing the more dominant MSB values first, the image processing pipeline may ensure a monotonic increase in color value when compared to a pipeline that process and adjust MSBs and LSBs in parallel. For example, in a process where the MSBs and LSBs are processed in parallel, MSBs may be adjusted down one bit even though the corresponding LSBs are adjusted up. This could result in a non-monotonic increase in value because the downward adjustment of MSBs is significantly more impactful than the adjustment of the LSBs. The sequential processing of the MSBs and LSBs alleviates this potential issue.

Hybrid PWM and Non-Uniformity Adjustment

A display device may exhibit different forms of non-uniformity of light intensity that may need to be compensated. A display non-uniformity may be a result of the non-uniformity of the light emitters among a set of light emitters that are responsible for a pixel location, the defeat of one or more light emitters, the non-uniformity of a waveguide, or other causes. Non-uniformity may be addressed by multiplying the color dataset by a scale factor, which may be a scalar. The scale factor increases the light intensity of the light emitters so that non-uniformity that is a result of a defective light emitter can be addressed. For example, in a set of six red light emitters responsible for a pixel location, if one of the light emitters is determined to be defective, the result of the five light emitters can be scaled up by a factor of 6/5 to compensate for the defective light emitter. In some cases, all different causes of non-uniformity may be examined and be represented together by a scalar scale factor.

FIG. 10 is a schematic block diagram of another example image processing unit 1000 that may be used with a display panel 380 that uses a hybrid modulation scheme. Compared to the embodiment shown in FIG. 9, the image processing unit 1000 of the embodiment shown in FIG. 10 has similar functionality but may perform one or more additional image processing tasks. Various embodiments may include additional or fewer blocks. In one case, the embodiment in FIG. 10 may be a more detailed version of the embodiment in FIG. 9.

At block 1005, a predetermined global scale factor may first be multiplied with an input color dataset. The global scale factor may be applied first to ensure that the color dataset, after different adjustment and scaling, will not exceed the maximum values allowed. The global scale factor may be in any suitable range. In one embodiment, the scale factor is between 0 and 1. At the addition block 1010, the input color dataset is adjusted by one or more error compensation values that are determined from one or more preceding pixel locations to generate an error-modified input color dataset $u_{ij}$.

At block 1015, the image processing unit 1000 may determine whether an error-modified dataset falls outside of a color gamut. In response to the error-modified input color dataset falling outside the color gamut, the image processing unit 1000 may adjust the error-modified dataset through operations such as a constant-hue mapping to bring the error-modified dataset back into the color gamut. For example, the constant-hue mapping may include moving the coordinate representing the $u_{ij}$ in a color space along a constant-hue line until the moved coordinate is within the color gamut. The color gamut may be referred to as a display gamut, which may be a common gamut that represents ranges of colors that a first and a second sets of light emitters (e.g., MSB light emitters and LSB light emitters) are commonly capable of emitting (e.g., color gamut 770 shown in FIG. 7C).

The project-back-to-gamut block 1015 serves multiple purposes. First, it ensures that the light emitters can emit light according to the color values provided because the color values should be within the common color gamut. Second, it limits the magnitude of errors by bringing $u_{ij}$ back to a pre-defined range, which is the common color gamut. This in turns prevents potentially unstable behavior of the image processing unit 1000. The mapping of color is discussed above in FIGS. 7A-C. The project-back-to-gamut block 1015 may be bypassed if the color values are within the common gamut.

At first subset extraction block 1020, the image processing unit 100 extracts a first subset of bits in a version of the input color dataset (e.g., the error-modified input color dataset or the adjusted error-modified input color dataset). The first subset of bits may include the MSBs. The values in the first subset of bits are divided at block 1025 by one or more MSB non-uniformity scale factors that are used to account for any defective light emitters in the set of light emitters that correspond to displaying MSBs of a color value. In one embodiment, a scale factor may be determined in accordance with the total number of non-defective light emitters in a first set of light emitters relative to the total number of light emitters in the set. For example, if the MSB light emitter set of a particular color for a pixel location has six light emitters but one of them is defective, the scale factor for the particular color should be 5/6 because there are five light emitters that remain functional. The scale factor should be in between zero and one, with the value of one representing that all light emitters are functional in the light emitter set. Since the scale factors in this embodiment are smaller than or equal to one, the division of the scale factor at block 1025 increases the color values in the first subset of bits, thereby increasing the light intensity of the remaining functional light emitters. Each color value may be divided by a respective scale factor.

At block 1035, the image processing unit 1000 may adjust the first subset of bits to generate the first output color sub-dataset for the first set of light emitters. The image processing unit 1000 may treat color values of the primary colors differently. For certain types of light emitters, light emitters of different colors may exhibit different degrees of color shift. For example, in one embodiment where red, green, and blue microLEDs are used, green microLEDs exhibit a larger shift in wavelength when current is changed compared to red microLEDs. Hence, the first output color sub-data includes adjusted values that account for different degrees of color shift. The adjustment may be performed using lookup tables (LUTs) representing mapping schemes that compensate for the shift in the colors of the MSB light emitters. Each primary color might have its own lookup table. The adjustment may also be performed using a correction matrix that compensates for the color shift of the MSB light emitters. After the adjustment, the first output color sub-dataset is sent to the display panel to drive the first set of light emitters, which may include three subsets of light emitters of different colors. In some embodiments, the adjustment at block 1035 is bypassed and the image adjustment is performed on only the LSBs.

The LSBs of the color values may be determined by comparing a difference between the input color dataset and the first output color sub-dataset. At block 1040, the scaled values of the first subset of bits are multiplied by the MSB non-uniformity scale factors 1030 to re-generate the first subset of bits. The second subset of bits is generated at the subtraction block 1045 by determining the difference between a version of the input color dataset and the first output color sub-dataset.

At block 1050, the values in the second subset of bits are divided at block 1050 by one or more LSB non-uniformity scale factor 1055 to account for any defective light emitters in the light emitters that correspond to the LSBs. The MSB scale factor 1030 and the LSB scale factor 1055 may have different values because the two scale factors are associated with different sets of light emitters. For example, there could be a defective light emitter in the MSB light emitter set but no defective light emitter in the LSB light emitter set. In this particular case, the MSB scale factor should be less than one while the LSB scale factor remains at one.

At block 1060, the image processing unit 1000 may adjust the second subset of bits to compensate for any color shift. The adjustment may be performed using LUTs representing mapping schemes that compensate for the shift in the colors of the LSB light emitters. The adjustment may also be performed using a correction matrix that compensates for the color shift of the LSB light emitters. An intermediate set of values may be adjusted from the second subset of bits and may be quantized at the quantizer block 1065 because the bit depth in the second subset of bits may be higher than the bit depth supported by the second set of light emitters. The quantizer block 1065 may generate the second output color sub-dataset for the second set of light emitters that correspond to the LSBs. At block 1070, the scaled values of the second subset of bits are multiplied by the LSB non-uniformity scale factors 1055 to re-generate the second subset of bits.

The first subset of bits and the second subset of bits are recombined at block 1080 to generate a combined output dataset $C_{ij}$. The combination may include reverting the adjustment applied to the first subset of bits at block 1082 and reverting the adjustment applied to the second subset of bits at block 1084. At block 1080, the image processing unit 1000 generates the combined output dataset $C_{ij}$ that represents the color displayed at the pixel location. At a subtraction block 1090, the image processing unit 1000 determines an error dataset $e'_{ij}$, which is a difference between a version of input color dataset (e.g., the error-modified input color dataset or the adjusted error-modified input color dataset) and the combined output dataset. The error represents the difference between the actual color displayed and the desired color at the pixel location. The error dataset $e'_{ij}$ is used to pass through an image kernel 1095 generate error correction datasets $e_{i+1j-1}$, $e_{i+1j}$, $e_{i+1j+1}$ that are fed back to the input side of the image processing unit 1000 to dither subsequent input color datasets.

While various embodiments of the image processing unit 375 are respectively shown in FIGS. 8, 9, and 10, the specific arrangements and orders of the functional blocks shown in those embodiments are examples only and are not limited as such. For example, while the output of the embodiments shown in FIGS. 9 and 10 are separated into two sub-datasets to drive two sets of light emitters, in another embodiment the output sub-datasets may be recombined to drive a single set of light emitters that use digital or analog modulation. Each embodiment may include additional or fewer functional blocks. Also, a functional block is that present in one embodiment may also be added to another embodiment that is not shown as having the functional block.

Example Algorithm and Calculation

In this section of the disclosure, an example implementation of algorithm and calculation is provided for illustrative purpose only. The numbers used in the example are for reference only and should not be regarded as limiting the scope of the disclosure. The algorithm and calculation may correspond to an embodiment of image processing unit 1000 that is similar to the one shown in FIG. 10. The display panel used in this example may use a hybrid modulation scheme to drive the light emitters.

In an embodiment, an input color dataset is denoted as $RGB_{ij}$, where i and j represent the indices for a pixel location. The input color dataset may be a vector that includes the barycentric weights of different primary colors. An image processing unit adjusts the input color dataset to generate an error-modified dataset $u_{ij}$ in the presence of various display errors. At a given pixel location i, j, there can be a residual error from previous quantization steps $e_{ij}$ which is added to the input color dataset to form the error-modified dataset $u_{ij}$:

$$u_{ij}=RGB_{ij}+e_{ij} \tag{1}$$

To prevent colors from being outside of the display gamut, the image processing unit performs a project-back-to-gamut operation to bring each individual value u of the color dataset $u_{ij}$ back to the gamut. In one embodiment, the operation is a clip operation such that $$u=\begin{cases}0 & u<0\\ 1 & u>1\end{cases} \tag{2}$$

In Equation (2), 0 and 1 represent the boundary of the gamut with respect with a color value. Other boundary values may be used, depending on how the display gamut's boundaries are defined. In other embodiment, other vector mapping techniques that project the dither color dataset back towards the display gamut could also be used instead. For example, the projection can be along a constant-hue line to map the color coordinate in a color space from outside the gamut back to the inside of the gamut along the line.

The image processing unit may extract first subset of bits (e.g., MSBs) from the error-modified dataset $u_{ij}$. Before color adjustment is performed, the image processing unit may scale the values in the MSBs with a MSB non-uniformity scale factor $m_{ij}$, which may be a pixelwise scale factor and may be defined to lie in the range of (0; 1]. The scaled value, MSB', of the MSBs may be determined by the following equation:

$$MSB'=\frac{MSB}{m_{ij}} \tag{3}$$

The image processing unit determines the MSB output pixel value in the first output color sub-dataset. The output MSB value, $p_{MSB}$ is determined by:

$$p_{MSB}=d_{MSB}\cdot\left\lfloor\frac{MSB'}{d_{MSB}}\right\rfloor \tag{4}$$

where $$d_{MSB}=\frac{1}{2^{n_{MSB}}-1} \tag{5}$$

and $\lfloor\ \rfloor$ represents the "floor" operator.

The image processing unit determines the second subset of bits (e.g., LSBs) by finding the remaining part of $u_{ij}$ that is not accounted for by the first output color sub-dataset corresponding to the MSBs. In one embodiment, the LSB value may be determined by:

$$LSB=u_{ij}-p_{MSB}m_{ij} \tag{6}$$

The LSB may also be compensated for non-uniformity by a LSB non-uniformity scale factor $l_{ij}$:

$$LSB'=\frac{LSB}{l_{ij}} \tag{7}$$

The image processing unit determines the LSB output pixel value in the second output color sub-dataset. The output LSB values, W, which may be referred to as the whole part, is determined by:

$$W=d_{LSB}\cdot\left\lfloor\frac{LSB'}{d_{LSB}}\right\rfloor \tag{8}$$

where $$d_{LSB} = \frac{1}{2^{n_{LSB}} - 1} \tag{9}$$

Since the floor operator is used, the difference between the output value and the input value lies within a cube which has vertices either at zero or the value of the quantization step size $d_{LSB}$. The remainder R, when scaled to the unit cube, is given by $$R = \frac{LSB' - W}{d_{LSB}} \tag{10}$$

The process of dithering is now reduced to finding R within the cube, selecting appropriate dither colors for R, and then adding the scaled result back to W. This process can be achieved by a tetrahedral search through the use of barycentric weights. A color R can be expressed as a linear combination of tetrahedron vertices $V=[v_1, v_2, v_3, v_4]$ and their associated barycentric weights $W=[w_1, w_2, w_3, w_4]$. In other words, $$R=WV^T \tag{11}$$

The unit cube within which R lies can be partitioned into six tetrahedrons, each of which has vertices that determine the color to which R may be adjusted. In one embodiment, the vertices are set to either zero or unity so that locating R within a tetrahedron can be performed through comparison operations. The barycentric weights are found using additions or subtractions.

Since there are a number of possible arrangements of the tetrahedral elements within the unit cube, in one embodiment, the one which corresponds to the Delaunay triangulation in opponent space is chosen. In other words, the arrangement which provides the most uniform tetrahedron volume distribution in opponent space may be chosen. The red, green and blue color components of the input color can be defined as $C_r$, $C_g$ and $C_b$ respectively. As a result, the vertices V and barycentric weights W can be determined using the following pseudocode.

```
if C_b>C_g
    C_m=C_r+C_b;
  if C_m>1
  if C_m>C_g+1% BRMW tetrahedron
  V=[0 0 1, 1 0 0, 1 0 1, 1 1 1];
  W=[1-C_r, 1-C_b, C_m-C_g-1, C_g];
  else % BRCW tetrahedron
  V=[0 0 1, 1 0 0, 0 1 1, 1 1 1];
  W=[C_b-C_g, 1-C_b, 1-C_m+C_g, C_m-1];
  end
  else % KBRC tetrahedron
  V=[0 0 0, 0 0 1, 1 0 0, 0 1 1];
  W=[1-C_m, C_b-C_g, C_r, C_g];
  end
  else
    C_y=C_r+C_g;
  if C_y>1
  if C_y>C_b+1% RGYW tetrahedron
  V=[1 0 0, 0 1 0, 1 1 0, 1 1 1];
  W=[1-C_g, 1-C_r, C_y-C_b-1, C_b];
  else % RGCW tetrahedron
  V=[1 0 0, 0 1 0, 0 1 1, 1 1 1];
  W=[1-C_g, C_g-C_b, 1+C_b-C_y, C_y-1];
  end
  else % KRGC tetrahedron
  V=[0 0 0, 1 0 0, 0 1 0, 0 1 1];
  W=[1-C_y, C_r, C_g-C_b, C_b];
  end
end
```

Figure 11:
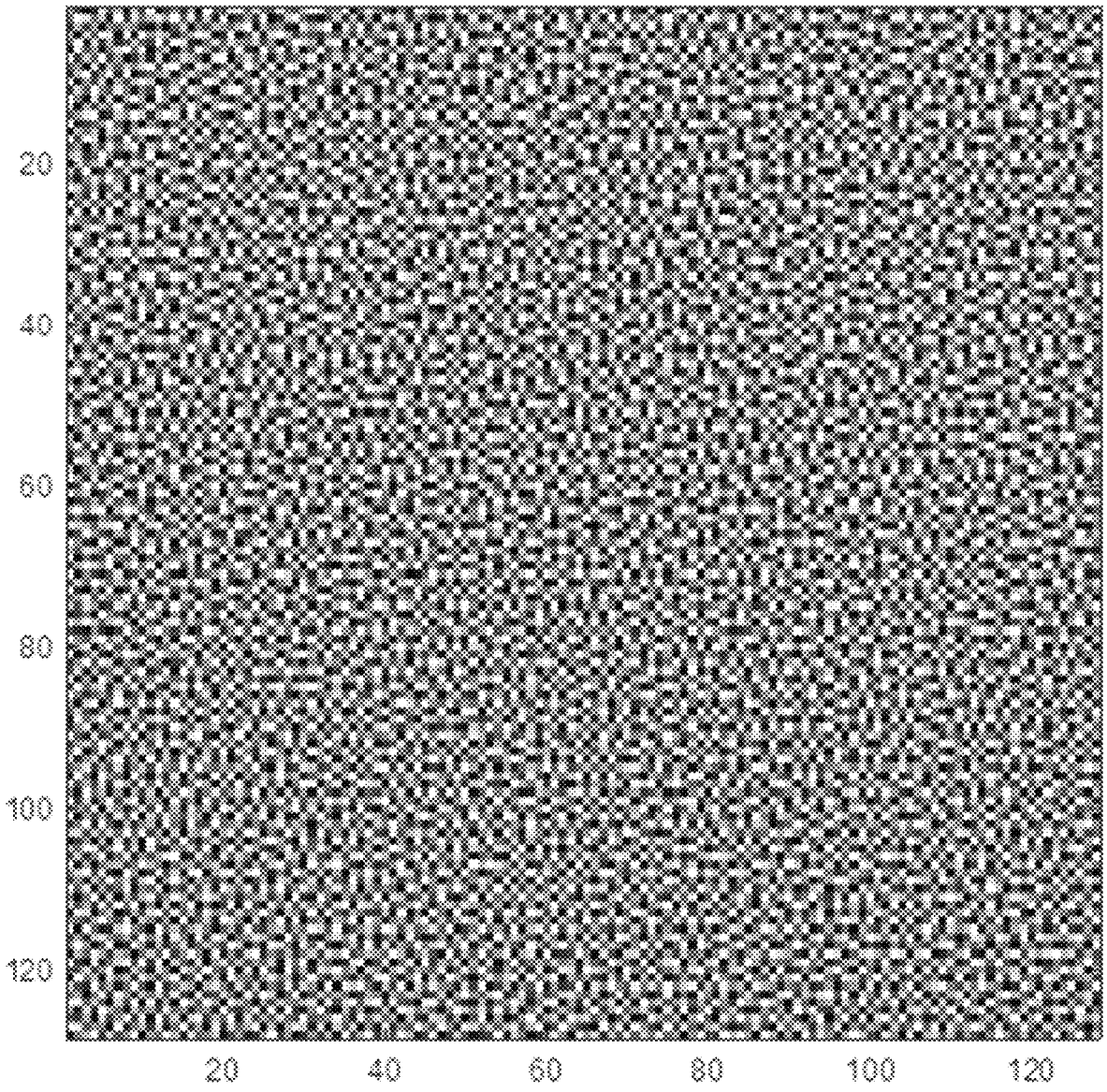
FIG. 11 is an image of an example blue noise mask pattern, in accordance with an embodiment.

The image processing unit may use a pre-defined blue noise mask pattern of size M×M pixels to determine the tetrahedron vertex that is to be used for dithering. An example blue noise mask pattern is shown in FIG. 11. The blue noise mask may be generated algorithmically such as using simulated annealing algorithm or void-and-cluster algorithm. The mask may be replicated over the image to be dithered so that a threshold value Q at an image pixel (x, y) is given by $$Q=\text{mask}\ (\text{mod}(x-1,M)+1,\text{mod}(y-1,M)+1) \tag{12}$$

Since the barycentric weights are summed to unity, and the blue noise mask is distributed in the interval [0; 1], the mask may be used to choose the tetrahedron vertex by considering the cumulative sum of the barycentric weights. The tetrahedron vertex $v_k$ is chosen when the sum of the first k barycentric weights exceeds the threshold value at that pixel, or $$v = v_k \text{ for which} \sum_{1}^{k} W > Q \tag{13}$$

After the dither vertex v is determined, a dithered color value may be determined as $$p_{MSB}=W+d_{LSB}\cdot v \tag{14}$$

The MSB sub-dataset and second subset of bits may be adjusted respectively by multiplying MSB correction matrix $M_{MSB}$ and LSB correction matrix $M_{LSB}$ to the sub-datasets. The matrices may be different for different kinds of light emitters and/or different driving current levels. In one case, the MSB correction matrix for 8-bit input data (4-bit MSBs, 4-bit LSBs) is the following:

$$\begin{bmatrix} R\ MSB \\ G\ MSB \\ B\ MSB \end{bmatrix} = \begin{bmatrix} 0.92 & .08 & 0 \\ 0 & 0.98 & 0.02 \\ 0 & 0 & 1 \end{bmatrix} \begin{bmatrix} R \\ G \\ B \end{bmatrix} \tag{15}$$

The LSB correction matrix for 8-bit input data (4-bit MSBs, 4-bit LSBs) is the following:

$$\begin{bmatrix} R\ LSB \\ G\ LSB \\ B\ LSB \end{bmatrix} = \begin{bmatrix} 0.99 & 0 & 0.01 \\ 0 & 1 & 0 \\ 0 & 0.17 & .83 \end{bmatrix} \begin{bmatrix} R \\ G \\ B \end{bmatrix} \tag{16}$$

In another case, the MSB correction matrix for 10-bit input data (5-bit MSBs, 5-bit LSBs) is the following:

$$\begin{bmatrix} R\ MSB \\ G\ MSB \\ B\ MSB \end{bmatrix} = \begin{bmatrix} 0.89 & .11 & 0 \\ 0 & 0.97 & 0.03 \\ 0 & 0 & 1 \end{bmatrix} \begin{bmatrix} R \\ G \\ B \end{bmatrix} \tag{17}$$

The LSB correction matrix for 10-bit input data (5-bit MSBs, 5-bit LSBs) is the following:

$$\begin{bmatrix} R\ LSB \\ G\ LSB \\ B\ LSB \end{bmatrix} = \begin{bmatrix} 0.99 & 0 & 0.01 \\ 0 & 1 & 0 \\ 0 & 0.18 & 0.82 \end{bmatrix} \begin{bmatrix} R \\ G \\ B \end{bmatrix} \tag{18}$$

The output color dataset may be obtained by recombining the MSBs and LSBs. For matrices $M_{MSB}$ and $M_{LSB}$ that represent transformations between a common gamut and the MSB or LSB gamut, the resultant color actually rendered by the display may be represented by:

$$C_{ij}=M_{MSB}^{-1}\cdot p_{MSB}\cdot m_{ij}+M_{LSB}^{-1}\cdot p_{LSB}\cdot l_{ij} \tag{19}$$

Hence, the difference between this color and the error-modified color of equation 1 is defined by equation 20 below.

$$e_{ij}=u-C_d \tag{20}$$

The error dataset $e_{ij}$ passes through an image kernel to determine values that will be propagated to neighboring pixel locations. The image kernel split the error values and add portions of the error value to existing error values stored in line buffers. In some cases, nearby pixel locations that are immediately adjacent to (e.g., next to, or right below) the pixel location i,j will receive larger portions of error values than neighboring pixel locations that are diagonal to the pixel location i, j. For example, the image kernel may be a Floyd-Steinberg kernel:

$$\begin{aligned} e_{i,j+1} &= e_{i,j+1} + \frac{7}{16}e_{ij} \\ e_{i+1,j+1} &= e_{i+1,j+1} + \frac{1}{16}e_{ij} \\ e_{i+1,j} &= e_{i+1,j} + \frac{5}{16}e_{ij} \\ e_{i+1,j-1} &= e_{i+1i,j-1} + \frac{3}{16}e_{ij} \end{aligned} \tag{21}$$

In some embodiments, to ease the implementation of this algorithm in hardware, the following kernel may also be employed:

$$\begin{aligned} e_{i+1,j+1} &= e_{i+1,j+1} + \frac{1}{4}e_{ij} \\ e_{i+1,j} &= e_{i+1,j} + \frac{1}{2}e_{ij} \\ e_{i+1,j-1} &= e_{i+1i,j-1} + \frac{1}{4}e_{ij} \end{aligned} \tag{22}$$

Example Image Dithering Process

Figure 12:
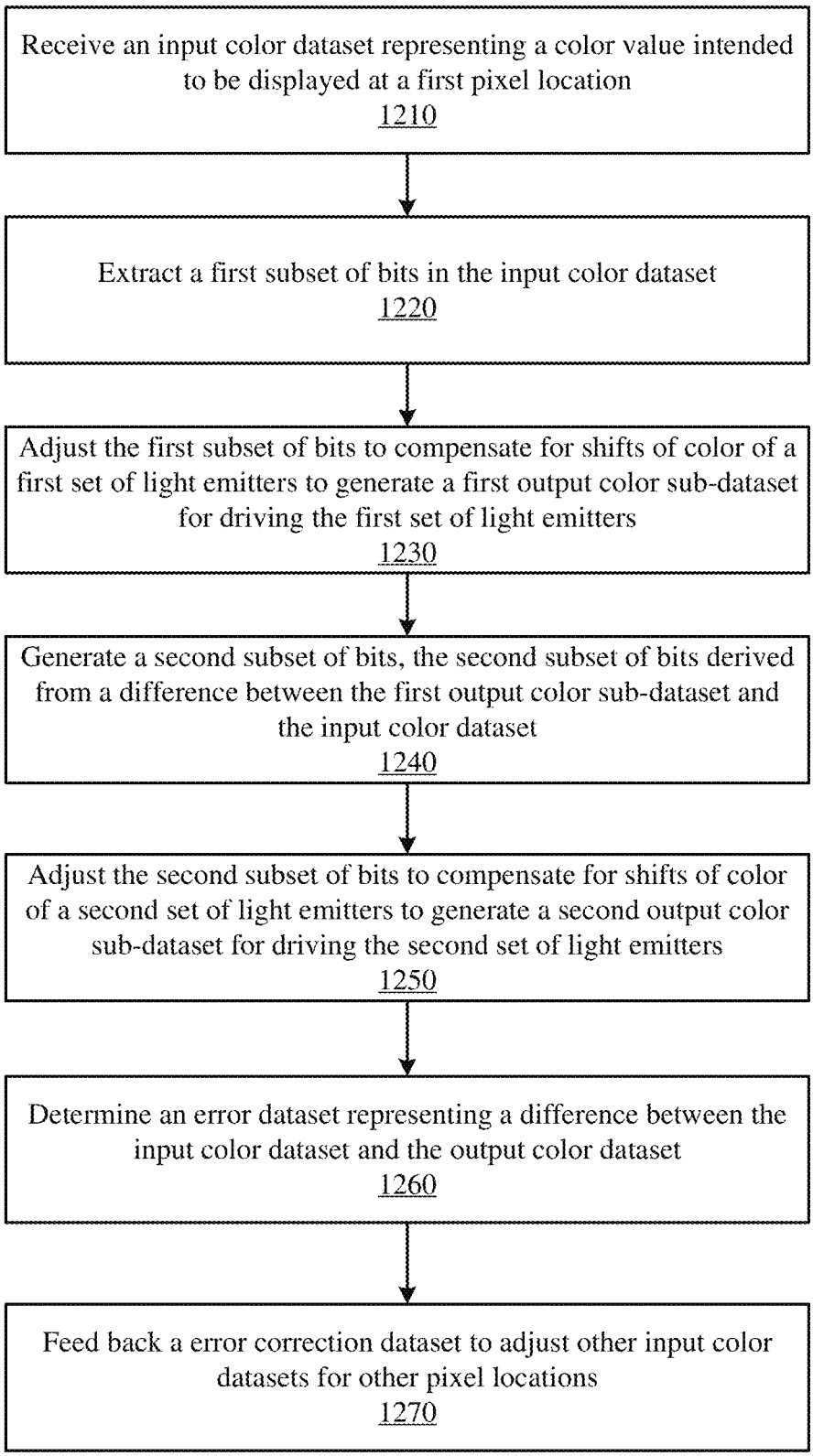
FIG. 12 is a flowchart depicting a process of operating a display device, in accordance with an embodiment.

FIG. 12 is a flowchart depicting a process of operating a display device, in accordance with an embodiment. The process may be operated by an image processing unit (e.g., a processor or a dedicated circuit) of the display device. The process may be used to generate the signals for driving light emitters of a display panel that uses a hybrid modulation. For each pixel location, the display device includes multiple sets of light emitters to emit light for the pixel location. For example, a first set of light emitters may include one or more red light emitters, one or more green light emitters, and one or more blue light emitters that are driven at a first current level for displaying MSBs of a color value at the pixel location. A second set of light emitters may likewise include one or more red light emitters, one or more green light emitters, and one or more blue light emitters that are driven at a second current level for displaying LSBs of the color value at the pixel location. In some embodiments, the display device includes redundant light emitters for each pixel location.

In accordance with an embodiment, a display device may sequentially process a first subset of bits and a second subset of bits of color values at each pixel location. At a given time, the display device may receive 1310 an input color dataset representing a color value intended to be displayed at a pixel location. The input color dataset may take the form of barycentric weights of three primary colors. In some cases, the input color dataset may be in a standard form or in a form that is defined by software or by an operating system that does not necessarily take into account of the design of the display panel of the display device. Also, the input color dataset may also be expressed in a bit depth that is higher than the hardware of the display panel. The display panel may also be subject to various operating constraints that may render the input color dataset incompatible with the driving circuit of the light emitters of the display device.

The display device extracts 1220 a first subset of bits in the input color dataset. The first subset of bits may include MSBs. The display device adjusts 1230 the first subset of bits to compensate for shifts of the color of the first set of light emitters to generate a first output color sub-dataset. The first set of light emitters are driven at a first current level to display MSBs of a color value at a first pixel location. The display device may take into account of various operating constraints of the light emitters and display panel in generating the first output color sub-dataset. The generation of the first output color sub-dataset may include multiple sub-steps. For example, the display device may scale the first subset of bits by one or more non-uniformity scale factors to compensate for non-uniformity of one or more components in the display device. The display device may also retrieve one or more look-up tables and use the look-up tables to generate the first output color sub-dataset.

The display device generates 1240 a second subset of bits. The second subset of bits may include LSBs. The second subset of bits may be derived from a difference between the first output color sub-dataset and the input color dataset. The second subset of bits may represent the residual color value that the first pixel location should display after the first subset of bits are displayed in order for the first pixel location to display a color value that is close to the desired color value specified in the input color dataset.

The display device adjusts 1250 the second subset of bits to compensate for shifts of color of the second set of light emitters to generate a second output color sub-dataset. The second set of light emitters that are driven at a second current level to display LSBs of a color value at the first pixel location. Similar to generating the MSB output, the display device may take into account various operating constraints of the light emitters and display panel in generating the second output color sub-dataset. The generation of the second output color sub-dataset may include multiple sub-steps. For example, the display device may scale the second subset of bits by one or more non-uniformity scale factors to compensate for non-uniformity of one or more components in the display device. The display device may also retrieve one or more look-up tables and use the look-up tables to generate the second output color sub-dataset. The display device may also quantize the second subset of bits.

The display device determines 1260 an error dataset that represents a difference between the output color datasets and the input color dataset. The error dataset at the first pixel location may be represented by a difference between the input and output datasets. The error may be propagated to one or more neighboring pixel locations to spread the error across a larger area to average the error. For example, the error dataset may pass through an image kernel to generate one or more error correction datasets that include the error compensation values for one or more nearby pixel locations. The display device feeds back 1270 an error correction dataset to adjust an input color dataset at a nearby pixel location that is in proximity to the first pixel location.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method for operating a display device, comprising:

receiving an input color dataset representing a color value intended to be displayed at a first pixel location, the color value corresponding to the first pixel location, the color value comprising a set of bits;

extracting a first subset of bits of the color value from the set of bits;

adjusting the first subset of bits of the color value to compensate for shifts of color of a first set of light emitters to generate a first output color sub-dataset for driving the first set of light emitters that emit light to the first pixel location;

generating a second subset of bits corresponding to the color value, the second subset of bits derived from a difference between the first output color sub-dataset and the input color dataset; and adjusting the second subset of bits of the color value to compensate for shifts of color of a second set of light emitters to generate a second output color sub-dataset for driving the second set of light emitters that emit light to the first pixel location.

2. The method of claim 1, further comprising:

combining the first and second color output sub-datasets to generate a combined dataset;

determining an error dataset corresponding to the first pixel location from a difference between the input color dataset and the combined dataset;

applying a dither algorithm to generate a plurality of error correction datasets from the error dataset, each of the plurality of error correction datasets being fed back for adjusting values of a nearby pixel location that is within a predetermined distance from the first pixel location;

receiving a second input color dataset for a second pixel location, the second pixel location being one of the nearby pixel locations; and adding one of the plurality of error correction datasets corresponding to the second pixel location to the second input color dataset.

3. The method of claim 2, wherein the dither algorithm is a Floyd-Steinberg dithering algorithm.

4. The method of claim 2, wherein the nearby pixel locations are in a next row of a row in which the first pixel location is located.

5. The method of claim 1, wherein adjusting the first subset of bits of the color value to compensate for shifts of color of the first set of light emitters to generate the first output color sub-dataset comprises deriving the first output color sub-dataset from the first subset of bits using one or more look-up tables.

6. The method of claim 1, wherein adjusting the second subset of bits of the color value to compensate for shifts of color of the second set of light emitters to generate the second output color sub-dataset comprises:

deriving an intermediate set of values from the second subset of bits using one or more look-up tables; and quantizing the intermediate set of values to generate the second output color sub-dataset.

7. The method of claim 1, wherein adjusting the first subset of bits comprises scaling the first subset of bits with a first scale factor representing a ratio of a number non-defective light emitters to a total number of light emitters in the first set of light emitters;

and wherein adjusting the second subset of bits comprises scaling the second subset of bits with a second scale factor representing a ratio of a number of non-defective light emitters to a total number of light emitters in the second set of light emitters.

8. The method of claim 1, wherein adjusting the first subset of bits comprises adjusting the first subset of bits using a first correction matrix that accounts for the shifts of color shift of the first set of light emitters; and wherein adjusting the second subset of bits comprises adjusting the second subset of bits using a second correction matrix that accounts for the shifts of color of the second set of light emitters.

9. The method of claim 1, wherein the first set of light emitters are driven at a first current level and the second set of light emitters are driven at a second current level different from the first current level.

10. The method of claim 9, wherein the first set of light emitters are driven by first pulse width modulation (PWM) signals at the first current level and the second subset of light emitters are driven by second PWM signals at the second current level.

11. The method of claim 1, further comprising:

adding correction values to the input color dataset to generate an error-modified color dataset, the correction values derived from processing of color values of pixel locations nearby the first pixel location;

determining whether the error-modified color dataset falls outside of a common color gamut of the first and second sets of light emitters; and converting, responsive to the error-modified color dataset falling outside of the common color gamut, the error-modified color dataset to an adjusted error-modified color dataset that falls within the common color gamut.

12. The method of claim 1, wherein the first subset of bits comprises most significant bits of the input color dataset, and the second subset of bits comprises least significant bits derived from the difference between the first output color sub-dataset and the input color dataset.

13. A display device, comprising:

a first set of light emitters configured to emit light to a first pixel location;

a second set of light emitters configured to emit light to the first pixel location; and an image processing unit configured to:

receive an input color dataset representing a color value intended to be displayed at the first pixel location, the color value corresponding to the first pixel location, the color value comprising a set of bits;

extract a first subset of bits of the color value from the set of bits;

adjust the first subset of bits of the color value to compensate for shifts of color of the first set of light emitters to generate a first output color sub-dataset for driving the first set of light emitters;

generate a second subset of bits corresponding to the color value, the second subset of bits derived from a difference between the first output color sub-dataset and the input color dataset; and adjust the second subset of bits of the color value to compensate for shifts of color of the second set of light emitters to generate a second output color sub-dataset for driving the second set of light emitters.

14. The display device of claim 13, wherein the image processing unit is further configured to:

combine the first and second color output sub-datasets to generate a combined dataset;

determine an error dataset corresponding to the first pixel location from a difference between the input color dataset and the combined dataset;

apply a dither algorithm to generate a plurality of error correction datasets from the error dataset, each of the plurality of error correction datasets being fed back for adjusting values of a nearby pixel location that is within a predetermined distance from the first pixel location;

receive a second input color dataset for a second pixel location, the second pixel location being one of the nearby pixel locations; and add one of the plurality of error correction datasets corresponding to the second pixel location to the second input color dataset.

15. The display device of claim 14, further comprising:

a third set of light emitters configured to receive a version of most significant bits of the second input color dataset; and a fourth set of light emitters configured to receive a version of least significant bits of the second input color dataset.

16. The display device of claim 15, wherein the third and fourth sets of light emitters are configured to emit light to the second pixel location.

17. The display device of claim 13, wherein the first set of light emitters are configured to emit light in a first range in accordance with a first color gamut and the second set of light emitters are configured to emit light in a second range in accordance with a second color gamut.

18. An image processing unit of a display device, comprising:

an input terminal configured to receive input color datasets for different pixel locations;

an output terminal configured to transmit signals to a display panel of the display device to drive a plurality of light emitters; and a data processing unit configured to:

for each pixel location, receive an input color dataset representing a color value intended to be displayed at the pixel location, the color value comprising a set of bits;

extract a first subset of bits of the color value from the set of bits;

adjust the first subset of bits of the color value to compensate for shifts of color of the first set of light emitters to generate a first output color sub-dataset for driving the first set of light emitters that are configured to emit light to the pixel location;

generate a second subset of bits corresponding to the color value, the second subset of bits derived from a difference between the first output color sub-dataset and the input color dataset; and adjust the second subset of bits of the color value to compensate for shifts of color of the second set of light emitters to generate a second output color sub-dataset for driving the second set of light emitters that are configured to emit light to the pixel location.

19. The image processing unit of claim 18, whether in the data processing unit is further configured to:

combine the first and second color output sub-datasets to generate a combined dataset;

determine an error dataset corresponding to the pixel location from a difference between the input color dataset and the combined dataset;

apply a dither algorithm to generate a plurality of error correction datasets from the error dataset, each of the plurality of error correction datasets being fed back for adjusting values of a nearby pixel location that is within a predetermined distance from the first pixel location;

receive a second input color dataset for a second pixel location, the second pixel location being one of the nearby pixel locations; and add one of the plurality of error correction datasets corresponding to the second pixel location to the second input color dataset.

20. The image processing unit of claim 18, wherein the data processing unit is a plurality of circuits, wherein a first circuit configured to generate the first output color sub-dataset is located upstream of a second circuit configured to generate the second output color sub-dataset.

* * * * *